United States Patent [19]

Ueda et al.

[11] Patent Number: 4,804,616

[45] Date of Patent: Feb. 14, 1989

[54] METHOD FOR PROCESSING SILVER HALIDE COLOR REVERSAL PHOTOGRAPHIC MATERIAL

[75] Inventors: Shinji Ueda; Junya Nakajima, both of Minami-ashigara, Japan

[73] Assignee: Fuji Photo Film Co., Ltd., Kanagawa, Japan

[21] Appl. No.: 122,703

[22] Filed: Nov. 19, 1987

[30] Foreign Application Priority Data

Nov. 19, 1986 [JP] Japan ..... 61-276231

[51] Int. Cl.[4] ..... G03C 5/50; G03C 5/24; G03C 7/00

[52] U.S. Cl. ..... 430/379; 430/372; 430/400; 430/407; 430/421; 430/428; 430/455; 430/456; 430/463; 430/491

[58] Field of Search ..... 430/379, 407, 372, 421, 430/463, 428, 491, 455, 456, 400

[56] References Cited

U.S. PATENT DOCUMENTS

| | | | |
|---|---|---|---|
| 4,083,723 | 4/1978 | Shimamura et al. | 430/376 |
| 4,336,324 | 1/1982 | Koboshi et al. | 430/372 |
| 4,567,134 | 1/1986 | Koboshi et al. | 430/372 |
| 4,618,569 | 10/1986 | Kurematsu et al. | 430/372 |
| 4,675,274 | 6/1987 | Ueda et al. | 430/379 |
| 4,717,648 | 1/1988 | Ueda et al. | 430/379 |

FOREIGN PATENT DOCUMENTS 0071402 2/1983 European Pat. Off. .

*Primary Examiner*—Mukund J. Shah

*Attorney, Agent, or Firm*—Birch, Stewart, Kolasch & Birch

[57] ABSTRACT

The present invention relates to a method for continuously processing a color reversal photographic material. After black and white development, the color reversal photographic material is rinsed in a bath wherein the replenishing amount per unit area of the photographic material is 3 to 50 times as much as the amount of processing solution carried over from the preceding bath in terms of volume ratio and the pH is 9.5 or below.

17 Claims, 1 Drawing Sheet

METHOD FOR PROCESSING SILVER HALIDE COLOR REVERSAL PHOTOGRAPHIC MATERIAL

BACKGROUND OF THE INVENTION (1) Field of the Invention

The present invention relates to a method for processing silver halide color reversal photographic materials, and more particularly to a method for processing silver halide color reversal photographic materials wherein the amount of washing water after the black and white development is considerably decreased, without deteriorating the photographic characteristics.

(2) Description of the Prior Art

Generally, the standard process of processing silver halide color reversal photographic materials (hereinafter referred to simply as color reversal photographic materials) that use negative emulsions consists of a black and white development step, a washing step, a reversing step, a color developing step, a washing and conditioning step, a desilvering step, and a washing and stabilizing step. Recently, in the processing of color photographic materials there have been studies showing that by decreasing considerably the amount of washing water in the washing bath after the desilvering step, the water supply pipeline for supplying washing water can be omitted and the amount of waste water from the whole processing system is thereby reduced, making easy both the treatment of the waste water and its processing to recover water. Techniques of reducing the amount of washing water are described, for example, in Japanese Patent Application (OPI) Nos. 8543/1982, 14834/1983, 184343/1984, 220345/1985, 238832/1985, 239784/1985 and 239749/1985, and in Japanese Patent Application No. 131632/1986.

However, in processing color reversal photographic materials the processing solution components for the black and white development (first development) are carried out into the subsequent color developing bath, the reversing bath, etc., and as such they are liable to accumulate therein and cause deterioration of the photographic performance. To prevent this, previously, the amount of washing water after the black and white development has been increased or the color reversal photographic material has been processed in an acid stop bath and a subsequent washing bath where the amount of washing water is so large that the black and white development solution components are prevented from being carried over into the subsequent bath.

Such methods of processing reversal color photographic materials are described, for example, in *Shashin Kogyo,* No. 36, Vol. IV, pages 22 to 26 (March 1978), and in Color Photographic Development/Practice of Enlargement (edition of film development) in *Shashin Kogyo,* an extra issue, pages 41 to 46 (May 1975).

Therefore, in conventional methods of processing color reversal photographic materials the generation of a large amount of waste water has not been avoided, and the treatment of the waste water and the recovery of water are serious problems.

BRIEF SUMMARY OF THE INVENTION

Therefore, the object of this invention is to provide a method for processing color reversal photographic materials wherein the reduction in waste water that has been considered difficult to achieve can be attained without deteriorating the photographic characteristics.

A further object of the present invention is to provide a method for processing color reversal photographic materials wherein a washing bath subsequent to the black and white development process can be omitted.

Other and further objects, features and advantages of the invention will appear more fully from the following description taken in connection with the accompanying drawing.

DETAILED DESCRIPTION OF THE INVENTION

Figure 1:
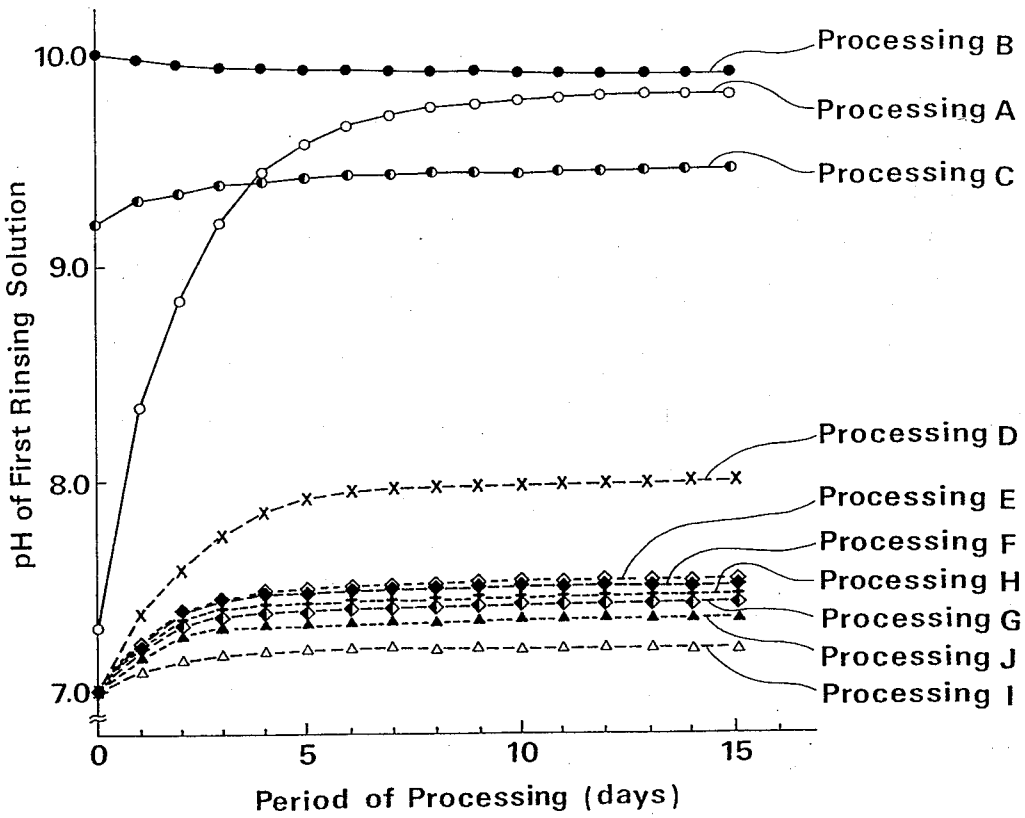
FIG. 1 is a graph showing the change of the pH value of the first rinsing solution during the continuous processing.

The inventors, in seeking improvement over the above-mentioned difficulties in the conventional methods of processing color reversal photographic materials, have found that their objective can be attained by rinsing the photographic material in a rinsing bath having a prescribed pH after the black and white development processing, followed by subsequent steps without processing the photographic material in a washing bath, which led to the present invention.

Therefore, the present invention provides a method for continuously processing a color reversal photographic material that has been exposed imagewise, characterized by the procedure that immediately after the said reversal photographic material is subjected to black and white development, it is rinsed in a rinsing bath wherein the replenishing amount (the supplemented amount of rinsing solution) per unit area of the said photographic material is 3 to 50 times as much as the amount of processing solution carried out from the preceding bath, in terms of volume ratio, and the pH is 9.5 or below, and the said photographic material can be then subjected to subsequent processes without being processed in a washing bath.

In the present method, after a color reversal photographic material is subjected to black and white development, it is rinsed in a rinsing bath and then processed in a reversing bath (fogging bath) or a color developing bath. In the present method, the term "subsequent processes" after the rinsing bath means the reversing bath process or the color developing bath process, and other processes that will follow.

In the present invention the replenishing amount in the rinsing bath per unit area of the said color reversal photographic material may be 3 to 50 times as much as the amount carried over from the preceding bath, in terms of volume ratio. This replenishing amount of the rinsing bath is on the order of about ½ to 1/30 the replenishing amount of washing water in the conventional washing process, wherein the replenishing amount of washing water per unit area is about 100 times as much as the amount carried over from the preceding bath, in terms of volume ratio, which means a considerable decrease in the replenishing amount of washing water. The amount carried over from the preceding bath is usually 30–300 ml per $m^2$ of the photographic material.

Generally, the pH of the rinsing bath in the present invention is 9.5 or below, but preferably, when the subsequent processing bath is a color developing bath, the rinsing bath is a buffer solution having a pH in the range of 5.0 to 9.5, in order to prevent the color development from lowering. A rinsing bath in which the pH can be maintained at 6.0 to 9.0, preferable 7.0 to 8.0, by adding a buffer solution when the processing machine is operated continuously, is preferable. Preferably the buffer solution will maintain the fluctuation of the pH to within ±1.2 before and after continuous operation.

When the amount of washing water (herein washing water simply means water) in the washing process of a conventional processing is decreased to the replenishing amount of the rinsing bath of the present invention, components of the black and white developing bath are carried over into the rinsing bath after the color development process, and the black and white developing agent is oxidized by air, which thereby colors the rinsing bath considerably. If a photographic material is processed in such a rinsing bath it becomes stained. When a photographic material is processed in an automatic developing machine, such a rinsing bath soils the tank. In contrast, according to the invention, the coloring of the solution in the rinsing bath due to the black and white developing agent after the color development process can be markedly suppressed.

In the present invention, in order to adjust the pH, various compounds can be added to the rinsing bath subsequent to the black and white development process. For example, various buffers (e.g., compounds having a pH buffering function, such as phthalates, phosphates, citrates, succinates, tetraborates, borates, tartrates, lactates, carbonates, propionates, isopropionates, butyrates, isobutyrates, glycine salts, dimethylglycine salts, diethylbarbiturates, 2,4,6-trismethylpyridine salts, tris(-hydroxymethyl)aminomethane salts, 2-amino-2-methyl-1,3-propanediol salts, and ammonium salts can be added.

In the present invention, although the amount of buffer to be added to the rinsing bath after the black and white development process can be in any range that exhibits the required buffering action, preferably the amount may be about $1.0\times10^{-5}$ mol to 1.0 mol, more preferably $1\times10^{-4}$ mol to $5\times10^{-1}$, per liter of the rinsing solution.

In the present invention, if the pH of the rinsing bath exceeds 9.5 the black and white development cannot be stopped, and as a result the desired gradation or maximum density cannot be obtained.

For the purpose of adjusting the pH of the rinsing bath, an alkali or acid such as sodium hydroxide, potassium hydroxide, hydrochloric acid, sulfuric acid or nitric acid can be added to the rinsing bath.

It is particularly preferable to add to the rinsing bath as chelate agents aminoorganicphosphonic acid compounds and organic phosphonic acid compounds described, for example, in Research Disclosure No. 18170 (May 1979), and Japanese Patent Application (OPI) Nos. 102726/1977, 42730/1978, 121127/1979, 4024/1980, 4025/1980, 126241/1980, 65955/1980, and 65956/1980. Specific examples of these phosphonic acid compounds are given below, but the invention is not limited to these compounds.

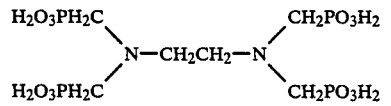
P-1

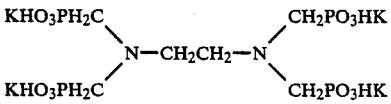
P-2

-continued

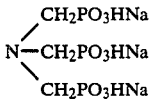
P-3

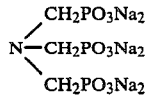
P-4

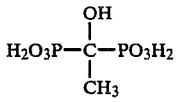
P-5

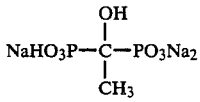
P-6

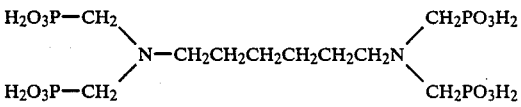
P-7

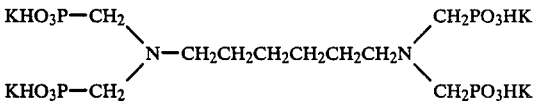
P-8

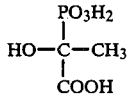
P-9

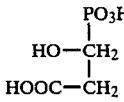
P-10

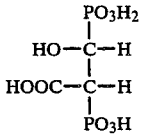
P-11

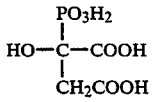
P-12

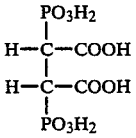
P-13

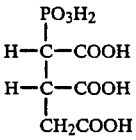
P-14

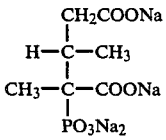
P-15

-continued
P-16
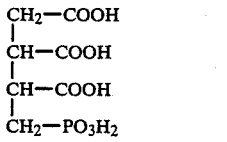
P-17
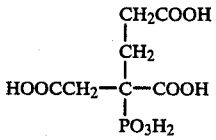
P-18
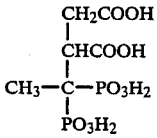
P-19
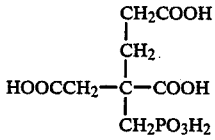
P-20
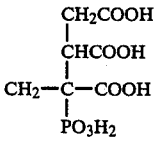
P-21
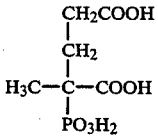
P-22
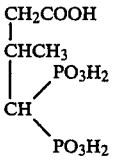
P-23
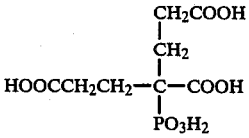
P-24
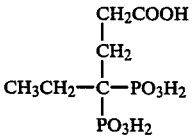
P-25
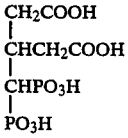
P-26
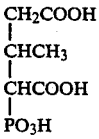
-continued
P-27
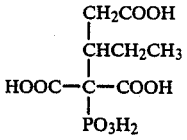
P-28
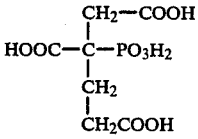
P-29
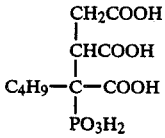
P-30
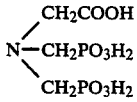
P-31
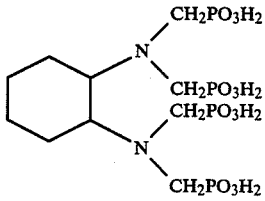
P-32
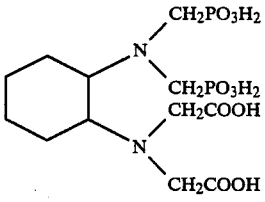
P-33
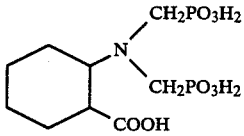
P-34
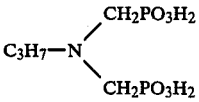
P-35
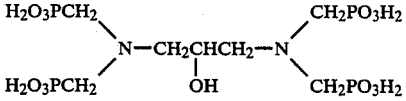
P-36
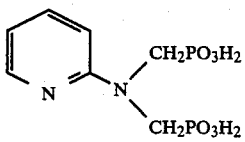
P-37
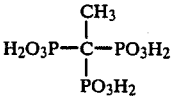

-continued
P-38
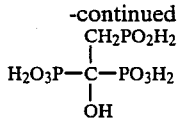
P-39
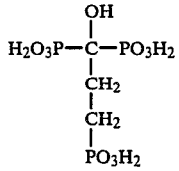
P-40
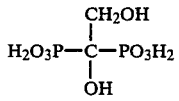
P-41
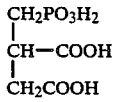
P-42
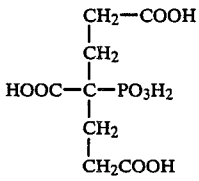
P-43
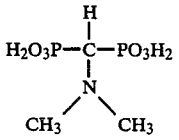
P-44
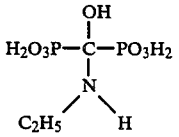
P-45
$HOCH_2CHCOH-CH_2O-PO_3Na_2$
P-46
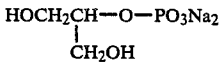
P-47
$HOCH_2COCH_2-O-PO_3H_2$
P-48
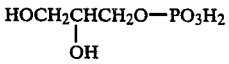
P-49
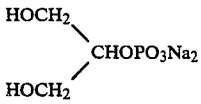
P-50
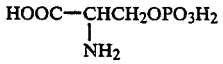
P-51
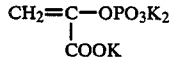
P-52
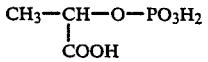
P-53
$NH_2CH_2CH_2O-PO_3H_2$
-continued
P-54
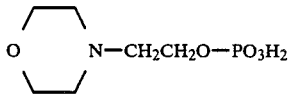
P-55
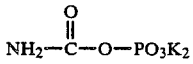
P-56
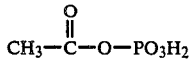
P-57
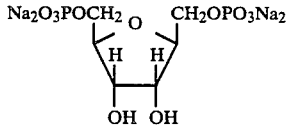
P-58
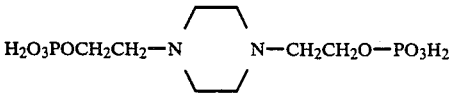
P-59
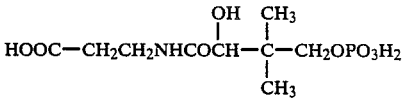
P-60
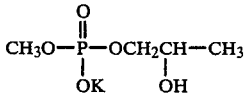
P-61
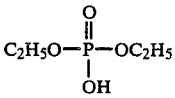
P-62
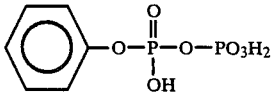
P-63
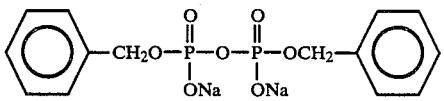
P-64
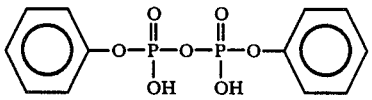
P-65
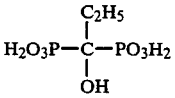
P-66
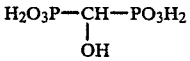
P-67
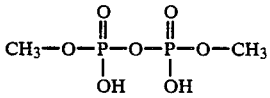
P-68
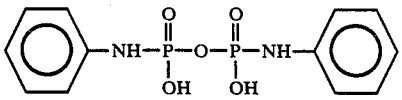

In the present invention, the amount of the phosphonic acid compound to be added to the rinsing bath is preferably $1.0\times10^{-4}$ mol to $1\times10^{-1}$ mol, more preferably $5\times10^{-4}$ mol to $5\times10^{-2}$ mol, per liter of the rinsing solution. The above organic phosphonic acid compounds can be added to the rinsing bath alone or in combination.

In the present invention it is preferable to add further to the rinsing bath various chelate compounds (e.g., polyphosphoric acid compounds such as sodium tetrapolyphosphate; aminopolycarboxylic acid compounds such as ethylenediaminetetraacetic acid, diethylenetriaminetetraacetic acid and nitrilotriacetic acid; salicyclic acid derivatives such as salicylic acid, and 5-sulfosalicylic acid; chelate compounds described in U.S. Pat. No. 4,482,626; and chelate compounds described in Japanese Patent Application (OPI) No. 203440/1983) to prevent metal ions such as calcium, magnesium and iron ions from precipitating.

In the present invention, in order to further enhance the effect of preventing the coloring due to black and white developing agent components entering from the preceding bath, the rinsing bath may contain, for example, aromatic polyhydroxy compounds described in Japanese Patent Application (OPI) Nos. 49828/1977, 47038/1981, 32140/1981, and 160142/1984 and U.S. Pat. No. 3,746,544, hydroxyacetones described in U.S. Pat. No. 3,615,503 and British Pat. No. 1,306,176, α-aminocarbonyl compounds described in Japanese Patent Application (OPI) Nos. 143020/1977 and 89425/1978, metals described in Japanese Patent Application (OPI) Nos. 44148/1982 and 53749/1982, saccharides described in Japanese Patent Application (OPI) No. 102727/1977, hydroxamic acids described in Japanese Patent Application (OPI) No. 27638/1977, α,α'-dicarbonyl compounds described in Japanese Patent Application (OPI) No. 160141/1984, salicylic acids described in Japanese Patent Application (OPI) No. 180588/1984, alkanolamines described in Japanese Patent Application (OPI) No. 3532/1979, poly(alkyleneimines) described in Japanese Patent Application (OPI) No. 94349/1981, gluconic acid derivatives described in Japanese Patent Application (OPI) No. 75647/1981, compounds described in Japanese Patent Application No. 169789/1986, or compounds described in Japanese Patent Application No. 265149/1986. If necessary, two or more of these preservatives may be used together. The amount of these compounds to be added is preferably $1\times10^{-5}$ to $5\times10^{-1}$ mol, more preferably $1\times10^{-3}$ to $1\times10^{-1}$ mol, per liter of the rinsing solution.

Further, in the present invention compounds conventionally known as air oxidation inhibitors may be added to the rinsing bath. Preferred examples for such addition are sulfites, bisulfites, metabisulfites, hydroxylamines, ascorbates, hydrazine compounds, and bisulfite adducts of aldehyde compounds.

In the present invention it is preferable that the overflow solution of the rinsing bath subsequent to the black and white development process be used as the replenishing solution or part of the replenishing solution for a washing bath after a processing bath having a fixing ability, or for a washing bath subsequent to a color developing bath so as to reduce the amount of washing water.

The major object of the present invention is to decrease the amount of waste water from the processing. To achieve this objective, the replenishing amount of each processing solution is reduced, thereby ultimately reducing the amount of waste fluids from the processing solutions. From this point of view, in the present invention it is preferable that the replenishing amount for each processing bath per unit area of the color reversal photosensitive material be up to 2.5 liters per $m^2$ of the photosensitive material, and the total of the replenishing amounts be 12.5 liters or below per $m^2$ of the photographic material.

In the present invention, when the pH of the rinsing bath subsequent to the black and white development process becomes near neutral, various microorganisms generate and sometimes a precipitate or matter suspension is formed in the rinsing bath. To prevent this, a method of reducing calcium and magnesium described in Japanese Patent Application (OPI) No. 131632/1986 is quite effective. It is also preferable to add compounds which can prevent the growth of bacteria, algae and fungi. For example, compounds described in *J. Antibact. Antifung. Agents,* Vol. 11, No. 5, pages 207 to 223 (1983), compounds described in Hiroshi Horiguchi, *Bokinbobai no Kagaku,* (Sankyo Shuppan, 1982), metal salts such as magnesium salts and aluminium salts, alkali metal salts, ammonium salts, and surface active agents can be added if necessary. Alternatively, compounds described, for example, in West, Phot. Sci. Eng., Vol. VI, pages 344 to 359 (1965) may be added. Particularly, the addition of chelate agents, fungicides and anti-mildew agents is effective.

Examples of fungicides and anti-mildew agents include thiazoles, isothiazoles, halogenated phenols, sulfanilamide, benzotriazole, etc.

Into the present rinsing bath can be added a brightening agent to improve the whiteness of the color reversal photosensitive material. As an example of such a brightening agent can be mentioned a stilbene system brightening agent, or the like.

The rinsing bath used in the present invention may consist of a single tank, but if the effect of reducing the replenishing amount for the rinsing bath is to be increased, it is preferable to use a multi-stage counter current replenishing system using two or more tanks.

The replenishing amount for the rinsing bath used in the present invention per unit area of the photographic material to be processed is 3 to 50 times as much as the amount carried over by the photographic material from the proceding bath, in terms of volume ratio. If the replenishing amount is less than 3 times as much as the amount carried over from the preceding bath, the rinsing becomes inadequate and components of the black and white developing solution are dragged into the rinsing bath, thereby deteriorating the photographic characteristics. On the other hand, if the replenishing amount is more than 50 times as much as the amount carried over from the preceding bath, it is also not preferable, because the rinsing effect reaches its saturation and the amount of waste fluid increases.

The period of the rinsing process in the present color reversal process is preferably 10 sec to 4 min, more preferably 20 sec to 2 min. Herein, by "the period of the rinsing process" is meant the time period from when the photographic material comes in contact with the rinsing solution to when the photographic material comes in contact with the process of the next bath, and it includes the so-called transferring period.

The processing temperature of the rinsing bath in the present invention is 15° to 60° C., more preferably 20° to 50° C.

In the black and white developing solution of the present invention can be used known developing agents. Such developing agents as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic ring compounds described in U.S. Pat. No. 4,067,872, such as a heterocyclic compound wherein 1,2,3,4-tetrahydroquinoline ring and an indolene ring are condensed, etc. may be used alone or in combination.

The black and white developing solution used in the present invention may further contain, if necessary, preservatives (e.g., sulfites, and bisulfites), buffers (e.g., carbonates, boric acid, borates and alkanolamines), alkali agents (e.g., hydroxides and carbonates), solubilization anxiliaries (e.g., polyethylene glycols and their esters), pH adjustors (e.g., organic acids such as acetic acid), sensitizers (e.g., quaternary ammonium salts), development accelerators, surface active agents, antifoaming agents, hardening agents, thickeners, etc.

It is required that the black and white developing solution used in the present invention contain a compound that acts as a silver halide solvent, and usually sulfites, added as a preservative as mentioned above, serve that role. Specific examples of sulfites and other silver halide solvents that can be used includes KSCN, NaSCN, $K_2SO_3$, $Na_2SO_3$, $K_2S_2O_5$, $Na_2S_2O_5$, $Na_2S_2O_3$, etc.

To provide a development accelerating effect, a development accelerator is used, and compounds having the following general formula (A) described in Japanese Patent Application (OPI) No. 63580/1982 can be used alone or in combination, and they can also be used together with the above silver halide solvent.

$$R_2\text{-}(S\text{—}R_1)d\text{—}S\text{—}R_2 \qquad (A)$$

wherein $R_1$ represents an alkylene group having 2 to 10 carbon atoms which may have an ether linkage, $R_2$ represents an alkyl group having 2 to 10 carbon atoms which may have a substituent and may contain an ether linkage or an ester linkage, and d is an integer from 0 to 3.

If the amount of the silver halide solvents used is too small, the progress of the development becomes too slow, while if the amount of the silver halide solvents is too large, fogging will occur in the silver halide emulsion, and therefore there is a preferable amount to be used, which can be determined by those skilled in the art.

For example, the amount of $SCN^-$ is 0.005 to 0.02 mols, more preferably 0.01 to 0.015 mols, per liter of the developing solution, and the amount of $SO_3^{2-}$ is 0.05 to 1 mol, more preferably 0.1 to 0.5 mol, per liter of the developing solution.

When the compounds of general formula (A) are added to the present black and white developing solution, the amount is preferably $5\times10^{-6}$ to $5\times10^{-1}$ mol, more preferably $1\times10^{-4}$ to $2\times10^{-1}$ mol, per liter of the developing solution.

In the present black and white development process may be employed various antifoggants to prevent development fogging. Preferred antifoggants are alkali metal halides such as potassium iodide, sodium bromide, and potassium iodide and organic antifoggants. Organic antifoggants can be made of nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, and hydroxyazaindolizine; mercapto-substituted heterocyclic compounds such as 1-phenyl-5-mercaptotetrazole, 2-mercaptobenzimidazole, and 2-mercaptobenzothiazole; and mercapto-substituted aromatic compounds such as thiosalicylic acid. These antifoggants include those which will leach out from the color reversal photographic material while it is being processed and accumulate in the developing solution.

The black and white developing solution in the present invention can contain an antiswelling agent (e.g., an inorganic salt such as sodium sulfate) and a water softener (e.g., polyphosphoric acids, aminopolycarboxylic acids, phosphonic acids, and aminophosphonic acids and their salts.)

The pH value of the developing solution thus prepared can be selected to give a prescribed density and a prescribed contrast, and it may be on the order of about 8.5 to about 11.5.

When sensitization is carried out using the first developing solution, the period should be prolonged up to 3 times as long as the standard processing. In this case, if the processing temperature is elevated the prolongation of the sensitization period can be shortened.

The fogging bath used in the present invention can contain a conventional fogging agent. That is, stannous ion complex salts such as stannous ion-organic phosphoric acid complex salts (see U.S. Pat. No. 3,617,282), stannous ion-organic phosphonocarboxylic acid complex salts (see Japanese Patent Publication No. 32616/1981), stannous ion-aminopolycarboxylic acid complex salts (see British Pat. No. 1,209,050), boron compounds such as boron hydride compounds (see U.S. Pat. No. 2,984,567), and heterocyclic amineborane compounds (see British Pat. No. 1,011,000) can be used. The pH of the fogging bath (reversing bath) may vary widely from the acid side to the alkali side, and it may be on the order of 2 to 12, preferably 2.5 to 10, and most preferably 3 to 9. Reversing may be carried out in a fogging bath or by reexposure, or it can be omitted by adding a fogging agent to the color developing bath.

In the present invention, the color developing solution used in the color developing process is preferably an alkaline aqueous solution containing as a major component an aromatic primary amine-system color developing agent. As this color developing agent, p-phenylenediamine system compounds can be preferably used. Typical examples of p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates or p-toluenesulfonates, or tetraphenylborates and p-(t-octyl)benzenesulfonates.

The concentration of the developing agent of the color developing solution and the pH of the color developing solution are very important factors for decreasing the development time, and in the present invention the developing agent is used in a concentration of about 1.0 g to about 15 g, preferably about 3.0 g to about 8.0 g, per liter of the color developing solution. Generally the pH of the color developing solution is 9 or over, most preferably about 9.5 to about 12.0.

Preferably the processing temperature of the color developing solution in the present invention is 30° to 50° C., most preferably 31° to 45° C.

In the present invention, when required, various development accelerators can also be used.

Development accelerators that can be used include benzyl alcohol; various pyridinium compounds as described, for example, in U.S. Pat. No. 2,648,604, Japanese Patent Publication No. 9503/1969, and U.S. Pat. No. 3,171,247; other cationic compounds; cationic dyes such as phenosafranine; neutral salts such as thallium nitrate and potassium nitrate; nonionic compounds such as polyethylene glycols, their derivatives and polythioethers described in Japanese Patent Publication No. 9304/1969, U.S. Pat. Nos. 2,533,990, 2,531,832, 2,950,970 and 2,577,127; and thioether type compounds described in U.S. Pat. No. 3,201,242.

In the color developing process of the present invention various antifoggants can additionally be used to prevent development fog. As an antifoggant in the developing process, it is preferable to use an alkali metal halide such as potassium bromide, sodium bromide and potassium iodide, and an organic antifoggant. Organic antifoggants that can be used nitrogen-containing heterocyclic ring compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole and hydroxyazaindolizine; mercapto-substituted heterocyclic compounds such as 1-phenyl-5-mercaptotetrazole, 2-mercaptobenzimidazole, and 2-mercaptobenzothiazole and mercapto-substituted aromatic compounds such as thiosalicylic acid. These antifoggants include antifoggants that can dissolve from the color reversal photographic material into the developing solution during the processing, and which accumulate in the developing solution.

Further, the color developing solution of the present invention can contain pH buffering agents such as carbonates, borates and phosphates of alkali metals; preservatives such as hydroxylamine, triethanolamine, bisulfites, sulfites and compounds described in West German Patent Application (OLS) No. 2,622,950; organic solvents such as diethylene glycol; dye forming couplers; competing couplers such as citrazinic acid, J-acid and H-acid; nucleating agents such as sodium boron hydride; auxiliary developers such as 1-phenyl-3-pyrazolidone; thickening agents; chelating agents such as ethylenediaminetetraacetic acid, nitrilotriacetic acid, cyclohexanediaminetetraacetic acid, iminodiacetic acid, N-hydroxymethylethylenediaminetriacetatic acid, diethylenetriaminepentaacetic acid, triethylenetetraminehexaacetic acid, and aminopolycarboxylic acids as described in Japanese Patent Application (OPI) No. 195845/1983, 1-hydroxyethylidene-1,1'-diphosphonic acid organic phosphonic acids described in *Research Disclosure* No. 18170 (May 1979), aminophosphonic acids such as aminotris(methylenephosphonic acid), ethylenediamine-N,N,N',N'-tetramethylenephosphonic acid, and phosphonocarboxylic acids described in Japanese Patent Application (OPI) Nos. 102726/1977, 42730/1978, 121127/1979, 4024/1980, 4025/1980, 126241/1980, 65955/1980, 65956/1980, and *Research Disclosure* No. 18170 (May 1979).

If required, the color developing bath may be divided into two or more baths, so that a color developing replenishing solution may be supplied from the first bath or the last bath to shorten the developing time or to reduce the amount of the replenishing solution.

The pH of the color developing solution is preferably in the range of about 8 to 13. The temperature of the color developing solution should be selected to be in the range of 20° to 70° C., preferably 30° to 60° C.

The color reversal photosensitive material is desilvered after the color development. The desilvering process includes the following steps:

1. (color development)-conditioning-bleaching-fixing
2. (color development)-washing-bleaching-fixing
3. (color development)-bleaching-fixing
4. (color development)-conditioning-bleaching-washing-fixing
5. (color development)-washing-bleaching-washing-fixing
6. (color development)-bleaching-washing-fixing
7. (color development)-washing-blixing (i.e., bleach-fixing)
8. (color development)-adjustment-blixing
9. (color development)-blixing
10. (color development)-washing-bleaching-blixing
11. (color development)-conditioning-bleaching-blixing
12. (color development)-bleaching-blixing
13. (color development)-washing-bleaching-blixing-fixing
14. (color development)-conditioning-bleaching-blixing-fixing
15. (color development)-bleaching-blixing-fixing The method of replenishing the above steps can be carried out either by supplying replenishing solutions to respective baths or, for processes 10 to 12, the overflow from the bleaching step may be introduce into the blixing bath and only the overflow from the fixing solution composition may be supplied into the blixing bath. For processes 13 to 15, the overflow of the bleaching solution may be introduced into the blixing bath, the overflow of the fixing solution may be introduced into the blixing solution in a counter flow manner, and both may be overflowed from the blixing bath.

Bleaching agents that can be used for the bleaching bath or the blixing bath in the present invention include compounds of polyvalent transition metal ions such as an iron(III) ion, cobalt(IV) ion, chromium(VI) ion, manganese(VII) ion and copper(II) ion, peroxides, and quinones. For example, ferricyanides, dichromic acid, chelate compounds of organic acids with iron(III) or cobalt(IV), ferric chloride, persulfates, hydrogen peroxide, permanganates, and benzoquinone can be used. Of these compounds, the ones which are currently most commonly used are iron(III) complexes of aminopolycarboxylic acids. Typical examples of these aminopolycarboxylic acids and their salts are given below, but this invention is not limited to them.

A-1: ethylenediaminetetraacetic acid
A-2: disodium ethylenediaminetetraacetate
A-3: diammonium ethylenediaminetetraacetate
A-4: tetra(trimethylammonium) ethylenediaminetetraacetate
A-5: tetrapotassium ethylenediaminetetraacetate
A-6: tetrasodium ethylenediaminetetraacetate
A-7: trisodium ethylenediaminetetraacetate
A-8: diethylenetriaminepentaacetic acid
A-9: pentasodium diethylenetriaminepentaacetate
A-10: ethylenediamine-N-(β-oxyethyl)-N,N',N'-triacetic acid
A-11: trisodium ethylenediamine-N-(β-oxyethyl)-N,N',N'-triacetate A-12: triammonium ethylenediamine-N-(β-oxyethyl)-N,N'-N'-triacetate
A-13: propylenediaminetetraacetic acid
A-14: disodium propylenediaminetetraacetic acid
A-15: nitrilotriacetic acid
A-16: trisodium nitrilotriacetate
A-17: cyclohexanediaminetetraacetic acid
A-18: disodium cyclohexanediaminetetraacetate
A-19: iminodiacetic acid
A-20: dihydroxyethylglycine
A-21: ethyletherdiaminetetraacetic acid
A-22: glycoletherdiaminetetraacetic acid
A-23: ethylenediaminetetrapropinic acid Of these compounds, A-1 to A-3, A-8, and A-17 to A-19 are particularly preferable.

Aminopolycarboxylic acid ferric complex salts may be used as they are, or ferric complex salts formed by using a ferric salt such as ferric sulfate, ferric chloride, ferric nitrate, ammonium ferric sulfate and ferric phosphate and an aminopolycarboxylic acid in solution. When they are used as complex salts one or a combination of two or more of them can be used. When a ferric salt and an aminopolycarboxylic acid are used in solution to form a complex salt, one or more ferric salts may be used. One or more aminopolycarboxylic acids may also be used. In either case, an aminopolycarboxylic acid may be used in excess to form a ferric ion complex salt.

The bleaching solution or the bleach-fixing solution containing a ferric ion complex salt may contain, in addition to the iron ion complex salt, a complex salt of a metal ion, such as a cobalt ion and copper ion.

In the present invention various bleaching and fixing accelerators may be added to the bleaching bath, the bleach-fixing bath, or an conditioning bath preceding them.

Examples of such bleaching accelerators are various mercapto compounds described, for example, in U.S. Pat. No. 3,893,858, British Pat. No. 1,388,42, and Japanese Patent Application (OPI) No. 141623/1978, compounds having a disulfide bond described in Japanese Patent Application (OPI) No. 95630/1978, thiazoline derivatives described in Japanese Patent Publication No. 9854/1978, isothiourea derivatives described in Japanese Patent Application (OPI) No. 94927/1978, thiourea derivatives described in Japanese Patent Publication Nos. 8506/1970 and 26586/1974, thioamide compounds described in Japanese Patent Application (OPI) No. 42349/1974, and dithiocarbamic acid salts described in Japanese Patent Application No. (OPI) 26506/1980.

Further bleaching accelerator agents that can be used are alkylmercapto compounds that may or may not be substituted by a hydroxyl group, a carboxyl group, a sulfonic acid group, or an amino group (wherein the alkyl group or the acetoxyalkyl group may have any substituent), or the like. Thioglycerin, α,α'-thiodipropionic acid, and α-mercaptobutyric acid can be exemplified. Compounds described in U.S. Pat. No. 4552834 can also be used.

Although the amount of compounds having a mercapto group or a disulfide linkage in the molecule, thiozoline derivatives, or isothiourea derivatives to be added to the bleaching solution is dependent on the type of the photographic material to be processed, the processing temperature, the period required for the processing, etc., the amount is suitably $1\times10^{-5}$ to $1\times10^{-1}$ mol, preferably $1\times10^{-4}$ to $5\times10^{-2}$ mol, per liter of the processing solution.

In the present invention, when compounds are added to the bleaching solution they are generally first dissolved in water, an alkali, organic acid, organic solvent, or the like, but if they are added directly to the bleaching bath in a powder form, the effect of accelerating the bleaching is the same.

The bleaching solution used in the present invention can contain, in addition to bleaching agents and the above compounds, a rehalogenating agent, for example bromides such as potassium bromide, sodium bromide and ammonium bromide, or chlorides such as potassium chloride, sodium chloride and ammonium chloride.

Further, the bleaching solution can contain nitrates such as sodium nitrate and ammonium nitrate, and other known additives that are usually used in a bleaching solution, for example one or more of inorganic acids and organic acids or their salts that have a pH buffering ability such as boric acid, borax, sodium metaborate, acetic acid, sodium acetate, sodium carbonate, potassium carbonate, phosphorous acid, phosphoric acid, sodium phosphate, citric acid, sodium citrate, and tartaric acid.

In the present invention, the amount of bleaching agent is 0.1–1 mol, preferably 0.2–0.5 mol, per liter of the bleaching solution.

The pH of the bleaching solution is to be 4.0 to 8.0, more preferably 5.0 to 6.5.

In the present invention the amount of the bleaching agent is 0.05 to 0.5 mol, preferably 0.1 to 0.3 mol, per liter of the bleach-fix solution.

Fixing agents that can be used in the bleach-fixing solution include thiosulfates such as sodium thiosulfate, ammonium thiosulfate, sodium ammonium thiosulfate, and potassium thiosulfate thiocyanates such as sodium thiocyanate, ammonium thiocyanate and potassium thiocyanate, thiourea, and thioethers. The amount of the fixing agent used is 0.3 to 3 mol, preferably 0.5 to 2 mol, per liter of the bleach-fixing solution.

In addition to the bleaching agent and the fixing agent, the bleach-fixing solution according to the present invention may contain the compounds contained in the above bleaching solution.

In the present invention, the amount of the overflow from the bleaching bath to be introduced into the bleach-fixing bath, and the amount of the fixing agent-containing solution to be supplied simultaneously are set such that the concentrations of the bleaching agent and the fixing agent in the bleach-fixing bath will fall within the above range, and although these amounts can be set variously depending on the relationship between the concentration of the bleaching agent in the overflow to be introduced and the concentration of the fixing agent to be supplied, the amounts are preferably 150 to 900 ml per $m^2$ of the photographic material.

In the present invention, known fixing agents that can be added to the fixing agent-containing solution include ammonium thiosulfate and sodium thiosulfate, and all other additives that can be added to a fixing solution such as sulfites, bisulfites, buffering agents, and chelate agents. The concentration of each component in the fixing agent-containing solution can be set at a concentration required for the bleach-fixing solution when the fixing agent-containing solution is mixed and diluted with the overflow from the bleaching bath, and it can be made higher than for the general occasion when a fixing agent-containing solution is supplied to a fixing bath. As a result, the amount of liquid to be discharged can be reduced and the load of the recovering process can be decreased.

The concentration of the fixing agent to be contained in the fixing agent-containing solution is preferably 0.5 to 4 mol/liter, more preferably 1 to 3 mol/liter.

The pH of the fixing agent-containing solution is preferably 6 to 10, more preferably 7 to 9. Aminopolycarboxylic acid ferric complex salts, ammonium halides, and alkali metal halides such as ammonium bromide, sodium bromide, and sodium iodide can also be added. The pH of the bleach-fixing bath in the present invention is 5 to 8, preferably 6 to 7.5.

In the present invention, to introduce the overflow from the bleaching bath to the bleach-fixing bath the overflow pipe of the bleaching bath may be connected directly to the bleach-fixing bath; or the overflow may be stored in another place, then mixed with the fixing agent-containing solution and transferred into the bleach-fixing bath; or the stored overflow may be transferred separately from the fixing agent.

In the present invention a washing step may be interposed between the bleaching bath and the bleach-fixing bath. The washing step may be one wherein the amount of supply water is largely decreased.

In the present invention the color reversal photosensitive material, after the desilvering such as fixing or bleach-fixing, is generally passed through a washing step and/or a stabilizing step.

The amount of washing water in the washing step can be set in a wide range depending on the uses and the properties (for example due to the material used, such as couplers) of the photosensitive material, the temperature of the washing water, the number of washing tanks (number of steps), the type of replenishing mode, such as counter current mode and concurrent mode, and other conditions. The relationship between the number of washing tanks and the amount of water in the multistage counter current mode can be determined according to a method described in *Journal of the Society of Motion Picture and Television Engineers,* Vol. 64, pages 248 to 253 (May 1955).

According to the multistage counter current method described in the above publication, although the amount of washing water can be decreased considerably, bacteria propagate due to the increased time the water stays in the tank, causing problems such as the adhesion of resulting suspended matter on to the photographic material. To solve such problems in the present method of processing a color photographic reversal material, a method of decreasing calcium and magnesium described in Japanese Patent Application No. 131632/1986 can be used very effectively. Further agents that can be used include isothiazolone compounds described in Japanese Patent Application (OPI) No. 8542/1982, and bactericides such as thiabendazoles, chlorine-type bactericides such as sodium chlorinated isocyanurate, benzotriazole, etc., as described in Hiroshi Horiguchi, *Bokinbobaizai no Kagaku, Biseibutsu no Mekkin, Sakkin, Bobai Gijutsu,* edited by Eiseigijutsu-kai, and *Bokinbobaizai Jiten,* edited by Nihon Bokinbobaigakkai.

The pH of the washing water for processing a color reversal photosensitive material in the present invention is 4 to 9, preferably 5 to 8. Although the temperature of the washing water and the period for washing are differently set according, for example, to the uses, and the properties of the photosensitive material, generally the temperature of the washing water and the period for washing are selected in the range of 15° to 45° C. for 20 sec to 10 min, preferably 25° to 40° C. for 30 sec to 5 min.

Further, in the present invention a color reversal photographic material can be processed by using a stabilizing solution directly, instead of the above washing water. In such a process of stabilizing, known methods as described, for example, in Japanese Patent Application (OPI) Nos. 8543/1982, 14834/1983, 184343/1984, 220345/1985, 238832/1985, 239784/1985, 239749/1985, 4054/1986, and 118749/1986. Particularly preferable for use is a stabilizing bath containing 1-hydroxyethylidene-1,1-diphosphonic acid, 5-chloro-2-methyl-4-isothiazoline-3-one, bismuth compounds, ammonium compounds, or the like.

In some cases a stabilizing process is carried out after the above washing process, and an example of such cases is a stabilizing bath containing formalin and a surface active agent that is used as a final bath for color reversal photographic materials for photographing.

Color reversal photographic materials to which the present method will be applied are next described. Any silver halide of silver bromide, silver bromoiodide, silver chlorobromide, silver bromochloroiodide, silver chloride and silver chloroiodide may be used in the emulsion layers of the photosensitive material, and silver bromoiodide is preferably used with a high sensitivity photosensitive material. For silver bromoiodide, its content is generally 40 mol % or less, preferably 20 mol % or less, and most preferably 10 mol % or less.

The silver halide grains may be so-called regular grains comprising regular crystals such as cubes, octahedrons or tetradecahedrones, or irregular crystals such as spherical crystals, crystals having crystal defects such as twin planes, or composites of these. Further, the silver halide may be a mixture of the grains having various crystal shapes.

The grain diameter of the silver halide grains may be fine grains of about 0.1 micron or less, or coarse grains wherein the diameter of the projected area is about 10 micron or less, and a monodisperse emulsion having a narrow distribution or a polydisperse emulsion having a wide dispersion can be used.

Tabular grains having an aspect ratio of 5 or over can be used in the emulsion layers.

The crystal structure of the emulsion grains may be uniform, or the outer halogen composition of the crystal structure may be different from the inner halogen composition, or the crystal structure may be layered. These emulsion grains are disclosed, for example, in British Pat. No. 1,027,146, U.S. Pat. Nos. 3,505,068, and 4,444,877, Japanese Patent Application No. 248469/1983. Silver halides whose compositions are different may be joined by the epitaxial joint, or a silver halide may be joined for example to a compound other than silver halides such as silver rhodanide, lead oxide, etc. These emulsion grains are disclosed in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962, and 3,852,067, Japanese Patent Application (OPI) No. 162540/1984, etc.

These various emulsions may be of a surface latent image type, wherein the latent image is mainly formed on the surface, or of an internal latent image type, wherein the latent image is formed in the grains, or of a type wherein the latent image is formed on the surface as well as in the grains. Grains whose insides are chemically sensitized can also be used.

The silver halide photographic emulsions that can be used in the present invention can be produced suitably by known means, for example by the methods described in *I. Emulsion Preparation and Types, Research Disclosure,* Vol. 176, No. 17643 (December 1978), pages 22–23, and in *Research Disclosure,* Vol, 187, No. 18716 (November 1979), page 649.

The photographic emulsions used in the present invention may be prepared by suitably using the methods described in P. Glafkides, in *Chimie et Physique Photographique,* Paul Montel (1967), in G. F. Duffin, *Photographic Emulsion Chemistry,* Focal Press (1966), in V. L. Zelikman et al., *Making and Coating Photographic Emulsions,* Focal Press (1964), etc. That is, any one of the acid, neutral, ammonia methods, etc. can be used; and to react a soluble silver salt with a soluble halide, any one of the single-jet or double-jet methods, or a combination of these, etc. can be used. A method where grains are formed in the presence of an excess of silver ions, the so-called reverse mixing method, can be used. As one type of double-jet method, the so-called controlled double-jet method can be used, where the pAg in the liquid phase where a silver halide is to be produced is kept constant. According to this method, a silver halide emulsion can be obtained where the crystal form is regular and the grain size is uniform.

To prepare the photographic emulsions, if required, use can be made of various silver halide solvents (e.g., ammonia, potassium rhodanide, and thioethers and thion compounds, described, for example, in U.S. Pat. No. 3,271,157, Japanese Patent Application (OPI) Nos. 12360/1976, 82408/1978, 144319/1978, 100717/1979, and 155828 1979, etc.).

A silver halide emulsion comprising regular grains used in the present invention can be obtained by controlling the pAg and the pH during the formation of the grains. Details are described, for example, in *Photographic Science and Engineering,* Vol. 6, pages 159–165 (1962), *Journal of Photographic Science,* Vol. 12, pages 242–251 (1964), and in U.S. Pat. No. 3,655,394 and British Pat. No. 1,413,748.

A typical example of a monodisperse emulsion is an emulsion wherein a least 95 wt. % of the silver halide grains having an average grain diameter of about 0.1 micron or over are within ±40% of the average grain diameter.

In the present invention, it is possible to use an emulsion wherein the average grain diameter is 0.25 to 2 microns and at least 95 wt.% of the silver halide grains or at least 95% of the number of the silver halide grains are within the average grain diameter ±20%. Methods of producing such an emulsion are disclosed in U.S. Pat. Nos. 3,574,628 and 3,655,394 and British Pat. No. 1,413,748. Monodisperse emulsions are described, for example, in Japanese Patent Application (OPI) Nos. 8600/1973, 39027/1976, 83097/1976, 137133/1978, 48521/1979, 99419/1979, 37635/1983 and 49938/1983 can be preferably used in the present invention. In the process of the formation or physical ripening of silver halide grains, a cadmium salt, a zinc salt, a lead salt, a thallium salt, an iridium salt or its complex salt, a rhodium salt or its complex salt, an iron salt or its complex salt or the like may also be present.

To remove the soluble silver salt from the emulsion before or after the physical ripening, the noodlewashing method, the flocculation settling method, the ultrafiltration method, or the like will be performed.

Generally the emulsion to be used in the present invention may be chemically ripened and spectrally sensitized after the physical ripening. Additives that will be used in these steps are described in *Research Disclosure* No. 17643 (December 1978) and No. 18716 (November 1979), and the involved sections are listed in the Table below.

Known photographic additives that can be used in the present invention are also described in *Research Disclosure* Nos. 17643 and 18716, and the involved sections are given in the Table below.

| | Additive | RD 17643 | RD 18716 |
|---|---|---|---|
| 1 | Chemical sensitizer | Page 23 | Page 648 (right column) |
| 2 | Sensitivity enhancing agents | | Page 648 (right column) |
| 3 | Spectral sensitizers and Supersensitizers | Pages 23–24 | Pages 648 (right column)–Page 649 (right column) |
| 4 | Brightening agents | Page 24 | |
| 5 | Fogging agents and Stabilizers | Pages 24–25 | Page 649 (right column) |
| 6 | Light absorbers and Filter dye ultraviolet absorbers | Pages 25–26 | Pages 649 (right column)–650(left column) |
| 7 | Stain preventive agents | Page 25 (right column) | Page 650 (left to right column) |
| 8 | Image dye stabilizers | Page 25 | |
| 9 | Hardeners | Page 26 | Page 651 (left column) |
| 10 | Binders | Page 26 | Page 651 (left column) |
| 11 | Plasticizers and Lubricants | Page 27 | Page 650 (right column) |
| 12 | Application aids and Surface active agents | Pages 26–27 | Page 650 (right column) |
| 13 | Antistatic agents | Page 27 | Page 650 (right column) |

Various color couplers can be used in the present invention, and examples thereof are described in patents cited in *Research Disclosure* No. 17643, VII-C-G. As dye forming couplers, couplers capable of developing three primary colors of the subtractive color process (i.e., yellow, magenta and cyan) by color development are important, specific examples of hydrophobic 4-equivalent or 2-equivalent couplers that have been made nondiffusible are couplers disclosed in patents cited in *Research Disclosure* No. 17643, VII-C and VII-D. In addition the following couplers can be used favorably in the present invention.

Representative examples of yellow couplers useful in this invention include couplers of the oil-protected (hydrophobically ballasted) acylacetoamide type, as illustrated in U.S. Pat. Nos. 2,407,210, 2,875,057, and 3,265,506. Typical examples of two-equivalent yellow couplers preferable in this invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in Japanese Patent Publication No. 10739/1983, U.S. Pat. Nos. 4,401,752 and 4,326,024, *Research Disclosure* No. 18053

(April 1979), British Pat. No. 1,425,020 and German Pat. (OLS) Nos. 2,219,917, 2,261,361, and 2,433,812. Couplers of the α-pivaloyl-acetoanilide type are superior in the fastness of formed dyed particularly on exposure to light, while couplers of the α-benzoylacetoanilide type are capable of forming high maximum density.

Magenta couplers useful for this invention include hydrophobic ballasted and couplers of the indazolone or cyanoacetyl type, preferably of the 5-pyrazolone or pyrazoloazole (e.g., pyrazolotriazole) type. 5-Pyrazolones substituted by an arylamino or acylamino group at the 3-position are preferable in view of the hue and maximum densities of formed dyes, and are illustrated in U.S. Pat. Nos. 2,311,082, 2,343,703, 2,600,788, 2,908,573, 3,062,653, 3,152,896 and 3,936,015.

Preferable coupling-off groups in the two-equivalent 5-pyrazolone couplers are nitrogen-linked coupling-off groups described in U.S. Pat. No. 4,310,619, and an arylthio group described in U.S. Pat. No. 4,351,897. The ballast groups described in European Pat. No. 73,636 have effects to enhance developed density in the 5-pyrazolone couplers.

Examples of pyrazoloazole couplers include pyrazolobenzimidazole described in U.S. Pat. No. 3,061,432, more preferably pyrazolo[5,1-c][1,2,4]triazoles described in U.S. Pat. No. 3,725,067, pyrazolotetrazoles described in *Research Disclosure* No. 24220 (June 1984), and Japanese Patent Application (OPI) No. 33552/1985 and pyrazolopyrazole described in *Research Disclosure,* No. 24230 (June 1984) and Japanese Patent Application (OPI) No. 43659/1985. Imidazo[1,2-b]pyrazoles, described in U.S. Pat. No. 4,500,630, are preferable, with respect to the reduced yellow side-absorption and fastness of developed dyes on exposure to light and pyrazolo[1,5-b][1,2,4]-triazoles, described in European Pat. No. 119,860 A, are particularly preferable.

The cyan couplers that can be used in this invention include ballasted and hydrophobic naphthol couplers and phenol couplers. An example of the naphthol couplers is that disclosed in U.S. Pat. No. 2,474,293, and preferred examples of naphthol couplers are such two-equivalent naphthol couplers as the oxygen atom splitting-off type disclosed in U.S. Pat. Nos. 4,052,212, 4,146,396, 4,228,233, and 4,296,200. Examples of the phenol couplers are those disclosed in U.S. Pat. Nos. 2,369,929, 2,801,171, 2,772,162, and 2,895,826.

Examples of cyan couplers stable to moisture and heat that can be advantageously used in this invention include phenol cyan couplers having a higher alkyl group than methyl group at the metal position of the phenol nucleus, as disclosed in U.S. Pat. No. 3,772,002, 2,5-diacylamino-substituted phenol cyan couplers disclosed in U.S. Pat. Nos. 2,772,162, 3,758,308, 4,126,396, 4,334,011, 4,327,173, German Pat. No. (OLS) 3,329,729 and European Patent No. 121,365, and phenol cyan couplers having a phenylureido group at the 2-position and an acylamino group at the 5-position disclosed in U.S. Pat. Nos. 3,446,622, 4,333,999, 4,451,559, and 4,427,767.

In color negative photographic materials for photographing, colored couplers may be employed in order to compensate the unnecessary absorption of the developed dyes. Typical examples include yellow-colored magenta couplers as illustrated in U.S. Pat. No. 4,163,670 and Japanese Patent Publication No. 39413/1982 and magenta-colored cyan couplers as illustrated in U.S. Pat. Nos. 4,004,929 and 4,138,253 and British Pat. No. 1,146,368. Further examples of the colored couplers are disclosed in *Research Disclosure,* No. 17643, VII-G above-described.

It is possible to improve the grainness by using the color couplers in combination with a coupler which forms a dye having a proper degree of diffusion. A magenta coupler of such type is disclosed in U.S. Pat. No. 4,366,237 and British Pat. No. 2,125,570; and a similar type of yellow, magenta, or cyan coupler is disclosed in European Pat. No. 96,570 and West German Patent Application (OLS) No. 3,234,533.

The dye-forming couplers and the special couplers described above may be dimeric, oligomeric or polymeric. Examples of the polymerized dye-forming couplers are disclosed in U.S. Pat. Nos. 3,451,820 and 4,080,211. Examples of polymerized magenta couplers are disclosed in British Pat. No. 2,102,173 and U.S. Pat. No. 4,367,282.

Couplers that will release a photographically useful residue along with the coupling reaction can also be used preferably in the present invention. As DIR couplers that will release a development restrainer, couplers described in patents described in *Research Disclosure* No. 17643, VII-F are useful.

Those that are preferable for the present invention are developing solution deactivating-type couplers described, for example, in Japanese Patent Application (OPI) No. 151944/1982, timing-type couplers described, for example, in U.S. Pat. No. 4,248,962 and Japanese Patent Application (OPI) No. 154234/1982, reactive-type couplers described, for example, in Japanese Patent Application No. 39653/1984, and, particularly preferably, developing solution deactivating-type DIR couplers described, for example, in Japanese Patent Application (OPI) Nos. 151944/1982, and 217932/1983, and Japanese Patent Application Nos. 75474/1984, 82214/1984 and 90438/1984, and reactive DIR couplers described, for example, in Japanese Patent Application No. 39653/1984.

Couplers that can be used in the present invention can be introduced into a photosensitive material by any one of various known dispersing methods, typically for example, by the solid dispersing method, the alkali dispersing method, or preferably the latex dispersing method, or most preferably the oil-in water dispersion method. In the oil-in-water dispersing method, after the coupler is dissolved in one or a combination of a high-boiling organic solvent with a boiling point of 175° C. or higher and a low-boiling so-called auxiliary-solvent, the mixture is dispersed finely into an aqueous medium such as a gelatin solution or into water in the presence of a surface active agent. Examples of high-boiling organic solvents are described in U.S. Pat. No. 2,322,027, etc. The dispersing may be accompanied by phase reversal of the emulsion, and, if required, the auxiliary-solvent is removed or decreased by distillation, noodle washing, ultrafiltration or the like, followed by application.

Regarding the process of the latex dispersion method, the effect thereof and specific examples of latexes for impregnation are described, for example, in U.S. Pat. No. 4,199,363, West German application (OLS) Nos. 2,541,274 and 2,541,230.

The photographic materials used in the present invention may contain, as a color fogging preventive agent or color mixing preventive agent, hydroquinone derivatives, aminophenol derivatives, amines, gallic acid derivatives, catechol derivatives, ascorbic acid derivatives, colorless couplers and sulfonamidophenol derivatives.

The photographic materials used in the present invention can include various fading preventive agents. Typical examples of organic fading preventive agents are hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines, and ether or ester derivatives wherein the phenolic hydroxyl group of these compounds is silylated or alkylated. Metal complexes such as (bissalicylaldoxymato)nickel complex and (bis-N,N-dialkyldithiocarbamato)nickel complexes can also be used.

The color reversal photosensitive material to which the present invention can be applied may be multi-layer, multi-color photographic materials having at least two different spectral sensitivities on a base. Generally, a multi-layer color photographic material has at least one red-sensitive emulsion layer, at least one green-sensitive emulsion layer, and at least one blue-sensitive emulsion layer on a base. The order of these layers are arbitrarily selected as desired. A preferable order of the layers is such that the red-sensitive emulsion layer, the green-sensitive emulsion layer and the blue-sensistive emulsion layer are arranged from the base side, or that the blue-sensitive emulsion layer, the red-sensitive emulsion layer and the green-sensitive emulsion layer are arranged from the base side. Each of these emulsion layers may consist of two or more emulsion layers of different sensitivity, or it may consist of two or more emulsion layers having the same sensitivity with a non-photosensitive layer between them. Generally the red-sensitive emulsion layer contains a cyan forming coupler, the green-sensitive emulsion layer contains a magenta forming coupler, and the blue-sensitive emulsion layer contains a yellow forming coupler, but in some cases the combination can be changed.

It is preferable that the color reversal photosensitive material used in the invention is provided, in addition to the silver halide emulsion layers, with suitable auxiliary layers, such as a protective layer, an intermediate layer, a filter layer, an antihalation layer, and a backing layer.

In the photographic materials to which the present invention can be applied, the photographic emulsion layers and other layers are applied on a generally flexible base of plastic film, paper, or cloth, or on a rigid base of glass, porcelain, or metal. Useful flexible bases include films made of cellulose derivatives (e.g., nitrocelluose, cellulose acetate, cellulose acetylate butyrate), synthetic polymers (e.g., polystyrene, polyvinyl chloride, polyethylene terephthalate, and polycarbonate), or paper coated or laminated with a baryta layer or an α-olefin polymer (e.g., polyethylene, polypropylene and ethylene/butene copolymer). Bases may be colored with a dye or a pigment or may be made black to shield light. Generally the surface of the bases is subjected to an undercoat treatment to assure favorable adhesion to the photographic emulsion layers, or the like. The base surface may be subjected to glow discharge, corona discharge, ultraviolet irradiation, flame treatment, or the like before or after the undercoat treatment.

To apply the photographic emulsion layers and other hydrophilic colloid layers, known coating methods such as the dip coating method, the roller coating method, the curtain coating method and the extrusion coating method can be used. If required the layers may be applied simultaneously by coating methods described in U.S. Pat. Nos. 2,681,294, 2,761,791, 3,526,528 and 3,508,947.

The present invention can be applied to various color reversal photosensitive materials. Typical examples are color reversal films for slides and television, and color reversal papers. The present invention can also be applied to black and white photosensitive materials that use mixtures of three color couplers, described, for example, in *Research Disclosure* No. 17123 (June 1978).

According to the present invention, a washing bath after the black and white development process can be omitted, the photographic performance can be prevented from being deteriorated, and the amount of waste water in processing color reversal photosensitive materials can be reduced considerably.

Next, the present invention will be described in detail in accordance with examples, but it should be understood that these examples are not intended to limit the scope of the present invention.

EXAMPLE 1

A color photographic material was prepared by multi-coatings composed of the following for the first to the twelfth layers on a two-side polyethylene laminated paper base. A white pigment ($TiO_2$) and a small amount of bluish dye (ultramarine) were included on the first layer side of the polyethylene film laminated.

COMPOSITION OF PHOTOSENSITIVE LAYERS

In the following compositions, each ingredient is indicated in g/m$^2$ of a coating amount, but the coating amount of the halogenated silver is indicated in g/m$^2$ of calculated silver.

| | |
|---|---|
| **First layer: Gelatin layer** | |
| Gelatin | 1.30 |
| **Second layer: Antihalation layer** | |
| Black colloid silver | 0.10 |
| Gelatin | 0.70 |
| **Third layer: Red-sensitive emulsion (low sensitivity) layer** | |
| Silver iodobromide emulsion spectral-sensitized by red-sensitizing dye (*1 and *2)(silver iodide: 4.0 mol %, average grain size: 0.4 μm) | 0.12 |
| Gelatin | 1.00 |
| Cyan coupler (*3) | 0.14 |
| Cyan coupler (*4) | 0.07 |
| Color mix inhibitor (*5, *6 and *7) | 0.10 |
| Solvent for coupler (*8 and *9) | 0.06 |
| **Fourth layer: Red-sensitive emulsion (highly sensitive) layer** | |
| Silver iodobromide emulsion spectral-sensitized by red-sensitizing dye (*1 and *2)(silver iodide: 5.0 mol %, average grain size: 0.7 μm) | 0.14 |
| Gelatin | 1.00 |
| Cyan coupler (*3) | 0.20 |
| Cyan coupler (*4) | 0.10 |
| Color mix inhibitor (*5, *6 and *7) | 0.15 |
| Solvent for coupler (*8 and *9) | 0.10 |
| **Fifth layer: Intermediate layer** | |
| Magenta colloid silver | 0.02 |
| Gelatin | 1.00 |
| Color mix inhibitor (*10) | 0.08 |
| Color mix inhibitor (*11 and *12) | 0.16 |
| Polymer latex (*13) | 0.10 |
| **Sixth layer: Green-sensitive emulsion (low sensitivity) layer** | |
| Silver iodobromide emulsion spectral-sensitized by green-sensitizing dye (*14)(silver iodide: 2.0 mol %, grain size: 0.4 μm) | 0.09 |
| Gelatin | 0.08 |
| Magenta coupler (*15) | 0.10 |
| Color mix inhibitor (*16) | 0.10 |
| Stain inhibitor (*17) | 0.01 |
| Stain inhibitor (*18) | 0.001 |
| Solvent for coupler (*11 and *19) | 0.15 |

-continued

| | |
|---|---|
| **Seventh layer: Green-sensitive emulsion (highly sensitive) layer** | |
| Silver iodobromide emulsion spectral-sensitized by green-sensitizing dye (*14)(silver iodide: 3.0 mol %, grain size: 0.9 μm) | 0.09 |
| Gelatin | 0.80 |
| Magenta coupler (*15) | 0.10 |
| Discoloration inhibitor (*16) | 0.10 |
| Stain inhibitor (*17) | 0.01 |
| Stain inhibitor (*18) | 0.001 |
| Solvent for coupler (*11 and *19) | 0.15 |
| **Eighth layer: Yellow filter layer** | |
| Yellow colloid silver | 0.20 |
| Gelatin | 1.00 |
| Color mix inhibitor (*10) | 0.06 |
| Solvent for color mix inhibitor (*11 and *12) | 0.15 |
| Polymer latex (*13) | 0.10 |
| **Ninth layer: Blue-sensitive emulsion (low sensitivity) layer** | |
| Silver iodobromide emulsion spectral-sensitized by blue-sensitizing dye (*20)(silver iodide: 2.0 mol %, grain size: 0.5 μm) | 0.13 |
| Gelatin | 0.50 |
| Yellow coupler (*21) | 0.20 |
| Stain inhibitor (*18) | 0.001 |
| Solvent for coupler (*9) | 0.05 |
| **Tenth layer: Blue-sensitive emulsion (highly sensitive) layer** | |
| Silver iodobromide emulsion spectral-sensitized by blue-sensitizing dye (*20)(silver iodide: 2.5 mol %, grain size: 1.2 μm) | 0.22 |
| Gelatin | 1.00 |
| Yellow coupler (*21) | 0.40 |
| Stain inhibitor (*18) | 0.002 |
| Solvent for coupler (*9) | 0.10 |
| **Eleventh layer: UV absorbing layer** | |
| Gelatin | 1.50 |
| UV Absorbent (*22, *6 and *7) | 1.00 |
| Color mix inhibitor (*23) | 0.06 |
| Solvent for color mix inhibitor (*9) | 0.15 |
| Irradiation inhibiting dye (*24) | 0.02 |
| Irradiation inhibiting dye (*25) | 0.02 |
| **Twelfth layer: Protective layer** | |
| Fine particle chlorobromide emulsion (silver chloride: 97 mol %, average grain size: 0.2 μm) | 0.07 |
| Gelatin | 1.50 |
| Gelatin hardner (*26) | 0.17 |

The compounds used in the preparation of the above photographic material were as follows:

*1: 5,5'-Dichloro-3,3'-di(3-sulfobutyl)9-ethylthiacarbonylcyanine sodium salt

*2: Triethylammonium-3-[2-{2-[3-(3-sulfopropyl)naphtho(1,2-d)thyazoline-2-indenmethyl]-1-butenyl}-3-naphtho(1,2-d)thiazolino]propanesulfonate

*3: 2-[α-(2,4-Di-t-amylphenoxy)hexanamido]-4,6-dichloro-5-ethylphenol

*4: 2-[2-Chlorobenzoylamido]-4-chloro-5-[α-(2-chloro-4-t-amylphenoxy)octanamido]-phenol

*5: 2-(2-Hydroxy-3-sec-5-t-butylphenyl)benzotriazole

*6: 2-(2-Hydroxy-5-t-butylphenyl)benzotriazole

*7: 2-(2-Hydroxy-3,5-di-t-butylphenyl)6-chlorobenzotriazole

*8: Dioctyl phthalate

*9: Trinonyl phosphate

*10: 2,5-Di-t-octylhydroquinone

*11: Tricresyl phosphate

*12: Dibutyl phthalate

*13: Poly(ethyl acrylate)

*14: 5,5'-Diphenyl-9-ethyl-3,3'-disulfopropyloxacarbocyanine sodium salt

*15: 6-Methyl-7-chloro-2-[1-methyl-2-{2-octyloxy-5-(2-octyloxy-5-t-octylbenzenesulfonamido)-benzenesulfonamido}ethyl]-1H-pyrazolo[1,5-b][1,2,4]triazole

*16: 3,3,3',3'-Tetramethyl-5,6,5',6'-tetrapropoxy-1,1'-bisspiroindane

*17: 3-(2-Ethylhexyloxycarbonyloxy)-1-(3-hexadecyloxyphenyl)-2-pyrazoline

*18: 2-Methyl-5-t-octylhydroquinone

*19: Trioctyl phosphate

*20: Triethylammonium-3-[2-3-benzylrhodanine-5-iridene)-3-benzoxyazolynyl]propanesulfonate

*21: α-Pivaloyl-α-[(2,4-dioxo-1-benzyl-5-ethoxyhydantoin-3-yl)-2-chloro-5-(α-2,4-di-t-amylphenoxy)buthane-amido]acetanilide

*22: 5-Chloro-2-(2-hydroxy-3-t-butyl-5-t-octyl)phenylbenzotriazole

*23: 2,5-Di-sec-octylhyroquinone

*24

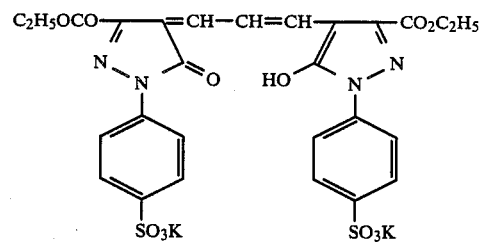

*25

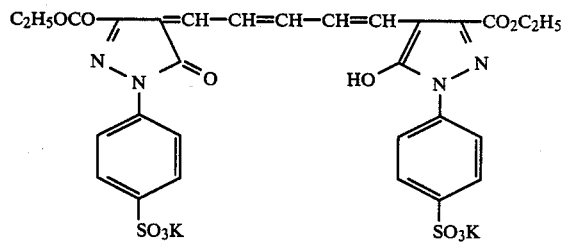

*26: 1,4-bis(vinylsulfonylacetamido)ethane

The photographic material thus prepared was exposed to light imagewise and then subjected to continuous processing using an automatic developing machine at 10 $m^2$ per day for 15 days according to the processing steps shown below.

| Processing Steps | Temperature (°C.) | Time (sec.) | Replenisher amount ($ml/m^2$) | Tank (l) |
|---|---|---|---|---|
| Black & White Development | 38 | 60 | 330 | 10 |
| First Rinsing | 38 | 60 | 500 | 10 |
| Reversal Exposure | (500 Lux) | 10 | — | — |
| Color Development | 38 | 60 | 330 | 10 |
| Second Rinsing | 38 | 30 | 330 | 5 |
| Bleach-fixing | 38 | 60 | 220 | 10 |
| Water Washing ① | 33 | 20 | — | 4 |
| Water Washing ② | 33 | 20 | — | 4 |
| Water Washing ③ | 33 | 20 | 330 | 4 |
| Drying | 70 | — | — | — |

The amount of replenisher is indicated in terms of ml per $m^2$ of the photographic material. (The same rule applies hereinafter).

The carried-over amount of the processing solution of black and white development to the first rinsing bath was 50 $ml/m^2$.

The washing steps with water were carried out by the so-called countercurrent replenishing mode, in which the overflow washing water from step ③ is fed to step ② , and the overflow washing water from step ② is fed to step ① .

The composition of each processing solution used in the processing steps mentioned above was as follows:

| Black & White Developing Solution | Tank Solution | Replenisher |
|---|---|---|
| Pentasodium nitrilo-N,N,N—trimethylenesulfonate | 0.6 g | 0.6 g |
| Pentasodium diethylenetriamine-penteacetate | 4.0 g | 4.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemono-sulfonate | 25.0 g | 25.0 g |
| Diethyleneglycol | 15.0 ml | 15.0 ml |
| 1-Phenyl-4-hydroxymethy-4-methyl-3-pyrazolidone | 2.0 g | 2.0 g |
| Potassium bromide | 0.05 g | |
| Potassium iodiode | 0.0005 g | |
| Water to make | 1000 ml | 1000 ml |
| pH | (9.7) | (9.70) |

| First Rinsing Solution (both tank solution and replenisher) | |
|---|---|
| A Solution | |
| Water is used | |
| B Solution | |
| $K_2CO_3$ | 5.0 g |
| Water to make | 1000 ml |
| (pH 10.0) | |

The pH of the following first rinsing solutions was adjusted using hydrochloric acid or sodium hydroxide.

| | |
|---|---|
| C Solution | |
| $K_2CO_3$ | 5.0 g |
| Water to make | 1000 ml |
| (pH 9.20) | |
| D Solution | |
| $KH_2PO_4$ | 6.0 g |
| Water to make | 1000 ml |
| (pH 7.0) | |
| E Solution | |
| $KH_2PO_4$ | 6.0 g |
| $NaHSO_3$ | 5.0 g |
| Water to make | 1000 ml |
| (pH 7.0) | |
| F Solution | |
| $KH_2PO_4$ | 6.0 g |
| Triethanolamine | 5.0 g |
| Water to make | 1000 ml |
| (pH 7.0) | |
| G Solution | |
| $KH_2PO_4$ | 6.0 g |
| Exemplified compound P-1 | 2.0 g |
| Water to make | 1000 ml |
| (pH 7.0) | |
| H Solution | |
| $KH_2PO_4$ | 6.0 g |
| Exemplified compound P-3 | 1.0 g |
| Water to make | 1000 ml |
| (pH 7.0) | |
| I Solution | |
| $KH_2PO_4$ | 6.0 g |
| Exemplified compound P-5 | 2.0 g |
| Diethylenetriaminepentaacetate | 2.5 g |
| Water to make | 1000 ml |
| (pH 7.0) | |

-continued

| | |
|---|---|
| J Solution | |
| $KH_2PO_4$ | 6.0 g |
| Exemplified compound P-1 | 2.0 g |
| $NaHSO_3$ | 5.0 g |
| Water to make | 1000 ml |
| (pH 7.0) | |
| P Solution | |
| $KH_2PO_4$ | 6.0 g |
| Exemplified compound P-1 | 2.0 g |
| Water to make | 1000 ml |
| (pH 7.0) | |

| Color Developing Solution | Tank Solution | Replenisher |
|---|---|---|
| Triethanolamine | 8.0 g | 10.0 g |
| N,N—Diethylhydroxylamine | 4.0 g | 5.0 g |
| 3,6-Dithia-1,8-octanediol | 0.2 g | 0.25 g |
| Disodium ethylenediaminetetra-acetate dihydrate | 2.0 g | 2.50 g |
| Sodium sulfite | 0.2 g | 0.25 g |
| Potassium carbonate | 25.0 g | 31.3 g |
| N—Ethyl-N—(β-methanesulfonamido-ethyl)-3-methyl-4-aminoaniline sulfonate | 8.0 g | 10.0 g |
| Potassium bromide | 0.5 g | 0.1 g |
| Potassium iodide | 1.0 mg | |
| Water to make | 1000 ml | 1000 ml |
| (pH | 10.4 | 10.80) |

| Second Rinsing Solution (both tank solution and replenisher) | |
|---|---|
| Sodium sulfite | 10.0 g |
| Disodium ethylenediaminetetra-acetate dihydrate | 4.0 g |
| Water to make | 1000 ml |
| (pH 7.2) | |

| Bleach-fix Solution (both tank solution and replenisher) | |
|---|---|
| 2-Mercapto-1,3,4-triazole | 0.5 g |
| Disodium ethylenediaminetetra-acetate dihydrate | 5.0 g |
| Ammonium iron (III) ethylenediaminetetra-acetate monohydrate | 80.0 g |
| Sodium sulfite | 15.0 g |
| Sodium thiosulfite (700 g/l) | 160.0 ml |
| Glacial acetic acid | 6.0 ml |
| Water to make | 1000 ml |
| (pH 6.0) | |
| Washing Water ①-③ (both tank solution and replenisher) | |

Tap water was treated by passage through a hybrid-type column filled with an H-type strong acidic cation-exchange resin (Diaion SK-1B, tradename, made by Mitsubishi Chemical Industries, Ltd.) and an OH type strong alkaline anion-exchange resin (Diaion SA-10A, tradename, made by Mitsubishi Chemical Industries, Ltd.) to obtain water as shown below. To the thus treated water, 20 mg/l of sodium dichloroisocyanurate was added as a bactericide.

Calcium ion: 1.1 mg/l
Magnesium ion: 0.5 mg/l
pH: 6.9

After the continuous processing described above, the absorbency at 500 nm of the first rinsing solutions and each yellow density at the white area and black area (minimum density) of the processed photographic material were measured. The results obtained are shown in Table 1. Also, the change of the pH value of the first rinsing solutions processed for 15 days are shown in FIG. 1. In FIG. 1, processings A to J indicate the processing using A solution to J solution, respectively.

TABLE 1

| Test No. | First Rinsing Solution | | Absorbency of the First Rinsing Solution | Yellow Density of White Area | Yellow Density of Black Area | pH Value of First Rinsing Solution after Continuous Processing |
|---|---|---|---|---|---|---|
| 1 | A | Comparative Example | 1.51 | 0.16 | 2.00 | 9.80 |
| 2 | B | Comparative Example | 1.48 | 0.15 | 1.83 | 9.90 |
| 3 | C | This Invention | 0.52 | 0.12 | 2.20 | 9.45 |
| 4 | D | This Invention | 0.25 | 0.09 | 2.25 | 8.00 |
| 5 | E | This Invention | 0.33 | 0.10 | 2.30 | 7.52 |
| 6 | F | This Invention | 0.20 | 0.09 | 2.32 | 7.50 |
| 7 | G | This Invention | 0.15 | 0.08 | 2.31 | 7.42 |
| 8 | H | This Invention | 0.23 | 0.10 | 2.30 | 7.44 |
| 9 | I | This Invention | 0.13 | 0.08 | 2.35 | 7.20 |
| 10 | J | This Invention | 0.15 | 0.08 | 2.32 | 7.35 |
| 11 | P | This Invention | 0.16 | 0.08 | 2.34 | 7.40 |
| 12 | Flowing Water Washing (1) | Comparative Example | 0.00 | 0.08 | 2.35 | 7.0 ± 0.5 |

Note: (1) Flowing Water Washing 7.5 l/day (corresponding to 250-fold amount of carried over solution from the black and white bath)

FIG. 1 indicates that the pH value of each first rinsing solution of treatments C to J and P is in a stabilized condition, under 9.5.

As is apparent from the results in Table 1, in each of Tests No. 3 to No. 11, as compared to Test No. 1 and No. 2, the absorbency, i.e., the coloration of the first rinsing solution, is in the lower level, and a good image with a lower density of the white area and a higher minimum density is obtained. In Test No. 12, in which the ordinary water washing treatment is employed, it is shown that the amount of washing water necessary to maintain the photographic property similar to that of Test No. 3 to No. 11 is a 250-fold amount of carried-over solution from the black and white developing bath.

EXAMPLE 2

A color photographic material was prepared by multi-coatings composed of the following for the first to the twelfth layers on a two-side polyethylene laminated paper base. A white pigment ($TiO_2$) and a small amount of bluish dye (ultramarine) were included on the first layer side of the polyethylene film laminated.

COMPOSITION OF PHOTOSENSITIVE LAYERS

In the following compositions, each ingredient is indicated in g/m$^2$ of a coating amount, but the coating amount of halogenated silver is shown in g/m$^2$ of calculated silver.

| | |
|---|---|
| First layer: Gelatin layer | |
| Same as Example 1 | |
| Second layer: Antihalation layer | |
| Same as Example 1 | |
| Third layer: Red-sensitive emulsion (low sensitivity) layer | |
| Silver iodobromide emulsion spectral-sensitized by red-sensitizing dye (*1 and *2) (silver iodide: 5.0 mol %, average grain size: 0.4 μm) | 0.15 |
| Gelatin | 1.00 |
| Cyan coupler (*3) | 0.14 |
| Cyan coupler (*4) | 0.07 |
| Color mix inhibitor (*5, *6 and *7) | 0.10 |

-continued

| | |
|---|---|
| Solvent for coupler (*8 and *9) | 0.06 |
| Fourth layer: Red-sensitive emulsion (highly sensitive) layer | |
| Silver iodobromide emulsion spectral-sensitized by red-sensitizing dye (*1 and *2) (silver iodide: 6.0 mol %, average grain size: 0.7 μm) | 0.15 |
| Gelatin | 1.00 |
| Cyan coupler (*3) | 0.20 |
| Cyan coupler (*4) | 0.10 |
| Color mix inhibitor (*5, *6 and *7) | 0.15 |
| Solvent for coupler (*8 and *9) | 0.10 |
| Fifth layer: Intermediate layer | |
| Same as Example 1 | |
| Sixth layer: Green-sensitive emulsion (low sensitivity) layer | |
| Silver iodobromide emulsion spectral-sensitized by green-sensitizing dye (*14) (silver iodide: 2.5 mol %, grain size: 0.4 μm) | 0.10 |
| Gelatin | 0.80 |
| Magenta coupler (*15) | 0.10 |
| Color mix inhibitor (*16) | 0.10 |
| Stain inhibitor (*17) | 0.01 |
| Stain inhibitor (*18) | 0.001 |
| Solvent for coupler (*11 and *19) | 0.15 |
| Seventh layer: Green-sensitive emulsion (highly sensitive) layer | |
| Silver iodobromide emulsion spectral-sensitized by green-sensitizing dye (*14) (silver iodide: 3.5 mol %, grain size: 0.9 μm) | 0.10 |
| Gelatin | 0.80 |
| Magenta coupler (*15) | 0.10 |
| Discoloration inhibitor (*16) | 0.10 |
| Stain inhibitor (*17) | 0.01 |
| Stain inhibitor (*18) | 0.001 |
| Solvent for coupler (*11 and *19) | 0.15 |
| Eighth layer: Yellow filter layer | |
| Same as Example 1 | |
| Ninth layer: Blue-sensitive emulsion (low sensitivity) layer | |
| Silver iodobromide emulsion spectral-sensitized by blue-sensitizing dye (*29) (silver iodide: 2.5 mol %, grain size: 0.5 μm) | 0.15 |
| Gelatin | 0.50 |
| Yellow coupler (*21) | 0.20 |
| Stain inhibitor (*18) | 0.001 |
| Solvent for coupler (*9) | 0.05 |
| Tenth layer: Blue-sensitive emulsion (highly sensitive) | |

-continued

| layer | |
|---|---|
| Silver iodobromide emulsion spectral-sensitized by blue-sensitizing dye (*20) (silver iodide: 2.5 mol %, grain size: 1.2 μm) | 0.25 |
| Gelatin | 1.00 |
| Yellow coupler (*21) | 0.40 |
| Stain inhibitor (*18) | 0.002 |
| Solvent for coupler | 0.10 |
| Eleventh layer: UV absorbing layer | |
| Same as Example 1. | |
| Twelfth layer: Protective layer | |
| Fine particle chlobromide emulsion (silver chloride: 97 mol %, average particle size: 0.2 μm) | 0.07 |
| Gelatin | 1.50 |
| Gelatin hardner (*26) | 0.17 |

The compounds used in the preparation of the above photographic material were as follows:

*1–*26: Same as Example 1.

The photographic material thus prepared was then subjected to continuous processing at 10 $m^2$ per day using a automatic developing machine for 15 days, according to the processing steps shown below. The carried-over amount of the processing solution of black and white development to the first rinsing bath was 50 $ml/m^2$.

| Processing steps | Temperature (°C.) | Time (sec.) | Replenisher Amount ($ml/m^2$) | Tank (l) |
|---|---|---|---|---|
| Black & White Development | 38 | 75 | 330 | 8 |
| Rinsing 1 | 38 | 30 | — | 4 |
| Rinsing 2 | 38 | 30 | 330 | 4 |
| Reversal development | (500 Lux) | 10 | — | — |
| Color Development | 38 | 135 | 330 | 15 |
| Bleaching | 38 | 30 | 120 | 4 |
| Bleaching-fixing | 38 | 30 | 120 | 4 |
| Water washing ① | 33 | 20 | — | 4 |
| Water washing ② | 33 | 20 | — | 4 |
| Water washing ③ | 33 | 20 | 330 | 4 |
| Drying | 70 | 45 | — | — |

In this processing operation, the replenishing of washing water in the washing steps was carried out by a countercurrent mode, and the overflowed bleaching solution was fed to the bleach-fixing bath.

The composition of each processing solution was as follows:

| Black & White Developing Solution | |
|---|---|
| Same as Example 1. | |
| First Rinsing Solution | |
| A Solution (both tank solution and replenisher) | |
| Same as Example 1. | |
| J Solution (both tank solution and replenisher) | |
| Same as Example 1. | |
| K Solution (both tank solution and replenisher) | |
| $K_2HPO_4$ | 6.0 g |
| $NaHSO_3$ | 5.0 g |
| Glycerol | 5.0 g |
| Water to make | 1000 ml |
| pH 7.0 | |
| L Solution (both tank solution and replenisher) | |
| $K_2HPO_4$ | 6.0 g |
| $NaHSO_3$ | 5.0 g |
| Hydroxylamine | 2.5 g |
| Water to make | 1000 ml |
| pH 7.0 | |
| M Solution (both tank solution and replenisher) | |
| $K_2HPO_4$ | 6.0 g |
| $NaHSO_3$ | 5.0 g |
| Trisodium 4,5-dihydroxy-1,3,6-benzenetrisulfonate | 6.5 g |
| Water to make | 1000 ml |
| pH 7.0 | |
| N Solution (both tank solution and replenisher) | |
| $K_2HPO_4$ | 6.0 g |
| $NaHSO_3$ | 5.0 g |
| Diethylhydroxylamine | 3.0 g |
| Water to make | 1000 ml |
| pH 7.0 | |

| Color Developing Solution | Tank Solution | Replenisher |
|---|---|---|
| Diethyleneglycol | 12 ml | 16 ml |
| Benzylalcohol | 14 ml | 18 ml |
| 3,6-Dithia-1,8-octanediol | 0.20 g | 0.25 g |
| Diethylenetriaminepentaacetate | 1.5 g | 2.0 g |
| Pentasodium nitrilo-N,N,N—trimethylenephosphonate | 0.4 g | 0.6 g |
| Sodium sulfite | 2.0 g | 2.5 g |
| N—Ethyl-N—(β-methanesulfonamidoethyl)-3-methyl-4-aminoaniline sulfate | 4.8 g | 6.0 g |
| Brightening Agent (Diaminostilbene series) | 1.0 g | 1.25 g |
| Water to make | 1000 ml | 1000 ml |
| pH | 10.30 | 10.60 |

| Bleaching Solution (both tank solution and replenisher) | |
|---|---|
| Ammonium bromide | 100 g |
| Ammonium iron (III) ethylenediaminetetra-acetate | 120 g |
| Disodium ethylenediaminetetra-acetate | 10.0 g |
| Sodium nitrate | 10.0 g |
| Water to make | 1000 ml |

| Bleach-Fix Solution | Tank Solution | Replenisher |
|---|---|---|
| Ammonium bromide | 50 g | — |
| Ammonium iron (III) ethylenediaminetetra-acetate | 60 g | — |
| Disodium ethylenediaminetetra-acetate | 5 g | 1.0 g |
| Ammonium nitrate | 5 g | — |
| 2-Mercapto-1,3,5-triazole | 0.4 g | 0.8 g |
| Sodium sulfite | 12.0 g | 20.0 g |
| Sodium thiosulfite | 240 ml | 400 ml |
| Water to make | 1000 ml | 1000 ml |
| pH | 7.3 | 8.0 |

Washing Water ①-③ (both tank solution and replenisher)
Same as Example 1.

After the continuous processing, measurements similar to those of Example 1 were carried out. The results are shown in Table 2.

TABLE 2

| Test No. | First Rinsing Solution | | Absorbency of the First Rinsing Solution 1 | Yellow Density of White Area | Yellow Density of Black Area | pH Value of First Rinsing Solution 1 after Continuous Processing |
|---|---|---|---|---|---|---|
| 1 | A | Comparative Example | 1.42 | 0.13 | 2.05 | 9.75 |
| 2 | J | This Invention | 0.18 | 0.08 | 2.30 | 7.41 |
| 3 | K | This Invention | 0.20 | 0.09 | 2.31 | 7.38 |
| 4 | L | This | 0.15 | 0.09 | 2.25 | 7.35 |

TABLE 2-continued

| Test No. | First Rinsing Solution | | Absorbency of the First Rinsing Solution 1 | Yellow Density of White Area | Yellow Density of Black Area | pH Value of First Rinsing Solution 1 after Continuous Processing |
|---|---|---|---|---|---|---|
| | | Invention | | | | |
| 5 | M | This Invention | 0.21 | 0.08 | 2.30 | 7.36 |
| 6 | N | This Invention | 0.21 | 0.09 | 2.32 | 7.40 |

As is evident from the results in Table 2, in each of Tests No. 2 to No. 6, as compared with Test No. 1, the absorbency, that is, the coloration of the first rinsing solution, is in the lower level, and a good image with a lower density of the white area and a higher minimum density is obtained.

EXAMPLE 3

A color photographic material was prepared by multi-coatings composed of the following composition on an undercoated triacetate cellulose film base.

| | |
|---|---|
| First layer: Antihalation layer | |
| Gelatin layer (dry film thickness: 2 μm) comprising the following ingredients: | |
| Black colloid silver | 0.25 $g/m^2$ |
| UV absorber U-1 | 0.04 $g/m^2$ |
| UV absorber U-2 | 0.1 $g/m^2$ |
| UV absorber U-3 | 0.1 $g/m^2$ |
| High-boiling organic solvent Oil-2 | 0.01 $ml/m^2$ |
| Second layer: Intermediate layer | |
| Gelatin layer (dry film thickness: 1 μm) comprising the following ingredients: | |
| Compound Cpd C | 0.05 $g/m^2$ |
| Compound I-1 | 0.05 $g/m^2$ |
| High-boiling organic solvent Oil-1 | 0.05 $ml/m^2$ |
| Third layer: First red-sensitive emulsion layer | |
| Gelatin layer (dry film thickness: 1 μm) comprising the following ingredients: | |
| Silver bromide emulsion spectral-sensitized by sensitizing dye S-1 and S-2 (average grain size: 0.3 m, AgI: 4 mol %) | |
| amount of silver | 0.5 $g/m^2$ |
| Coupler C-1 | 0.2 $g/m^2$ |
| Coupler C-2 | 0.05 $g/m^2$ |
| Coupler I-1 | $2 \times 10^{-3}$ $g/m^2$ |
| High-boiling organic solvent Oil-1 | 0.12 $ml/m^2$ |
| Fourth layer: Second red-sensitive emulsion layer | |
| Gelatin layer (dry film thickness: 2.5 μm) comprising the following ingredients: | |
| Silver bromide emulsion spectral-sensitized by sensitizing dye S-1 and S-2 (Emulsion D, average grain size: 0.6 μm, AgI: 3 mol %) | |
| amount of silver | 0.8 $g/m^2$ |
| Coupler C-1 | 0.55 $g/m^2$ |
| Coupler C-2 | 0.14 $g/m^2$ |
| Compound I-2 | $1 \times 10^{-3}$ $g/m^2$ |
| High-boiling organic solvent Oil-1 | 0.33 $ml/m^2$ |
| Dye D-1 | 0.02 $g/m^2$ |
| Fifth layer: Intermediate layer | |
| Gelatin layer (dry film thickness: 1 μm) comprising the following ingredients: | |
| Compound Cpd C | 0.1 $g/m^2$ |
| Dye D-2 | 0.02 $g/m^2$ |
| Sixth layer: First green-sensitive emulsion layer | |
| Gelatin layer (dry film thickness: 1 μm) comprising the following ingredients: | |
| Silver iodobromide emulsion containing the sensitizing dye S-3 and S-4 (average grain size: 0.3 μm, AgI: 4 mol %) | |
| amount of silver | 0.7 $g/m^2$ |
| Coupler C-3 | 0.20 $g/m^2$ |
| Coupler C-5 | 0.10 $g/m^2$ |

-continued

| | |
|---|---|
| High-boiling organic solvent Oil-1 | 0.26 $m/m^2$ |
| Seventh layer: Second green-sensitive emulsion layer | |
| Gelatin layer (dry film thickness: 2.5 m) comprising the following ingredients: | |
| Silver iodobromide emulsion containing the sensitizing dye S-3 and S-4 (Emulsion C, average grain size: 0.6 μm, AgI: 2.5 mol %) | |
| amount of silver | 0.7 $g/m^2$ |
| Coupler C-4 | 0.10 $g/m^2$ |
| Coupler C-5 | 0.10 $g/m^2$ |
| High-boiling organic solvent Oil-2 | 0.05 $m/m^2$ |
| Dye D-3 | 0.05 $g/m^2$ |
| Eighth layer: Intermediate layer | |
| Gelatin layer (dry film thickness: 1 μm) comprising the following ingredients: | |
| Compound Cpd C | 0.05 $g/m^2$ |
| High-boiling organic solvent Oil-2 | 0.1 $ml/m^2$ |
| Dye D-4 | 0.01 $g/m^2$ |
| Ninth layer: Yellow filter layer | |
| Gelatin layer (dye film thickness: 1 μm) comprising the following ingredients: | |
| Yellow colloid silver | 0.1 $g/m^2$ |
| Compound Cpd C | 0.02 $g/m^2$ |
| Compound Cpd B | 0.03 $g/m^2$ |
| High-boiling organic solvent Oil-1 | 0.04 $ml/m^2$ |
| Tenth layer: First Blue-sensitive emulsion layer | |
| Gelatin layer (dry film thickness: 1.5 μm) comprising the following ingredients; | |
| Silver iodobromide emulsion containing the sensitizing dye S-5 (Emulsion B, average grain size: 0.3 μm, AgI: 2 mol %) | |
| amount of silver | 0.6 $g/m^2$ |
| Coupler C-6 | 0.1 $g/m^2$ |
| Coupler C-7 | 0.4 $g/m^2$ |
| High-boiling organic solvent Oil-1 | 0.1 $ml/m^2$ |
| Eleventh layer: Second blue-sensitive emulsion layer | |
| Gelatin layer (dry film thickness: 3 μm) comprising the following ingredients: | |
| Silver iodobromide emulsion containing the sensitizing dye S-6 (Emulsion A, average grain size: 0.6 μm, AgI: 2 mol %) | |
| amount of silver | 1.1 $g/m^2$ |
| Coupler C-6 | 0.4 $g/m^2$ |
| Coupler C-8 | 0.8 $g/m^2$ |
| High-boiling organic solvent Oil-1 | 0.23 $ml/m^2$ |
| Dye D-5 | 0.02 $g/m^2$ |
| Twelfth layer: First Protective layer | |
| Gelatin layer (dry film thickness: 2 μm) comprising the following ingredients: | |
| UV absorbent U-1 | 0.02 $g/m^2$ |
| UV absorbent U-2 | 0.32 $g/m^2$ |
| UV absorbent U-3 | 0.03 $g/m^2$ |
| High-boiling organic solvent Oil-2 | 0.28 $ml/m^2$ |
| Thirteenth layer: Second Protective layer | |
| Gelatin layer (dry film thickness: 2.5 μm) comprising the following ingredients: | |
| Surface fogged fine grain iodobromide emulsion (average grain size: 0.06 μm, I: 1 mol %) | |
| amount of silver | 0.1 $g/m^2$ |
| Poly(methyl methacrylate) particles (average particle diameter: 1.5 μm) | |

In each layer described above, a gelatin hardener (*26 in Example 1) and a surfactant were added.

The compounds used in the above layers were as follows:

C-1 2-Perfluorobutyramido-5-[α-(2-cyanophenoxy) tetradecanamido]phenol

C-2 2-Perfluorobutyramido-5-[α-(2,4-di-t-amylphenoxy) hexanamido]phenol

C-3 1-(2,4,6-trichlorophenyl)-3{3-[α-(2.4-di-t-amylphenoxy)butyramido]benzoylamido}-5-pyrazolone

C-4

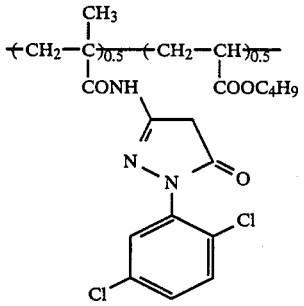

C-5 6-Methyl-7-chloro-2-[1-methyl-2-{2-octyloxy-5-(2-octyloxy-5-t-octylbenzenesulfonamido)-benzenesulfon-amido}ethyl]-1H—pyrazolo[1,5-b][1,2,4]triazole C-6 α-Pivaloyl-α-[(2,4-dioxo-1-benzyl-5-ethoxyhydantoin-3-yl)]-2-chloro-5-dodecanoxycarbonyl acetanilide C-7 α-Pivaloyl-α-(4-methyoxycarbonylphenoxy)-2-chloro-5-hexadecanesulfonamide-acetanilide C-8 α-Pivaloyl-α-{4(4-hydroxyphenylsulfonyl)-phenoxy}-2-chloro-5-dodecanoxycarbonyl-acetanilide 1-1

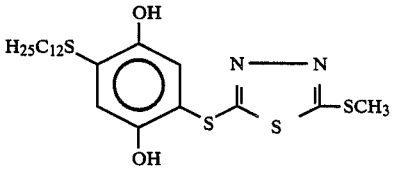

1-2

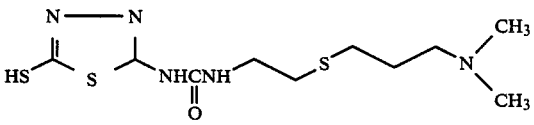

U-1 2-(2-hydroxy-3,5-di-t-butylphenyl)-6-chlorobenzotriazole

U-2 2-(2-hydroxy-5-t-butylphenyl)benzotriazole

U-3 2-(2-hydroxy-3,5-di-t-butylphenyl)-benzotriazole

Cpd B 2,5-di-t-octylhydroquinone

Cpd C 2,5-di-sec-octylhydroquinone

S-1

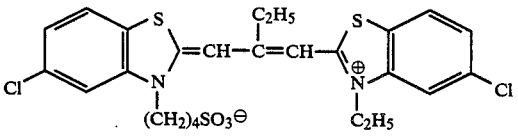

S-2

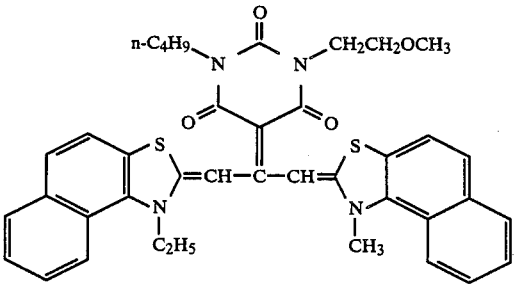

-continued
S-3
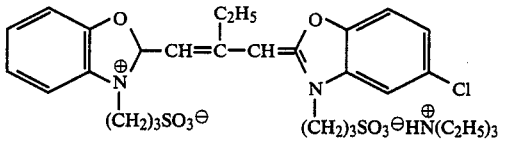
S-4
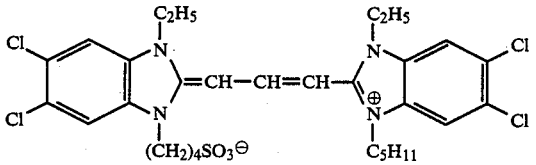
S-5
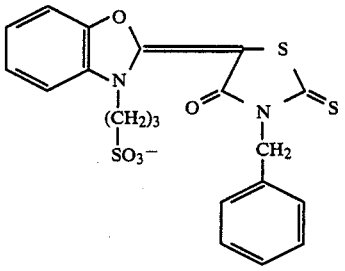
S-6
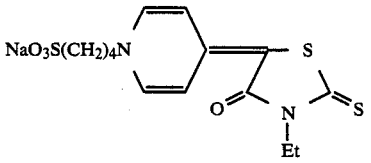
D-1
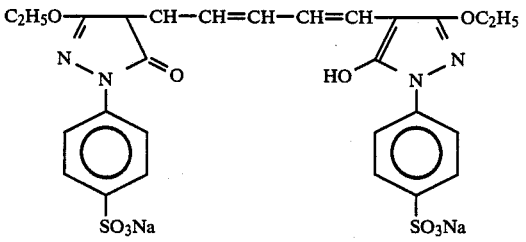
D-2
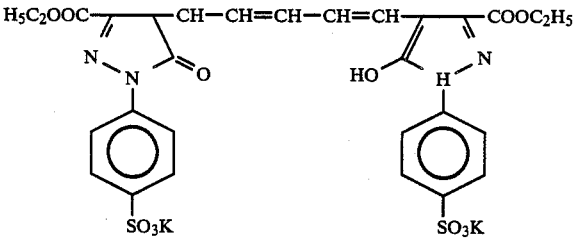
D-3
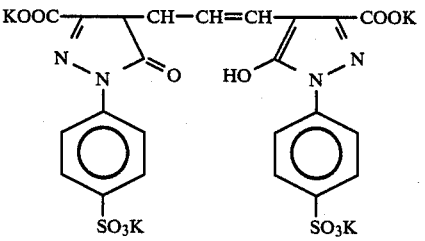

-continued

D-4

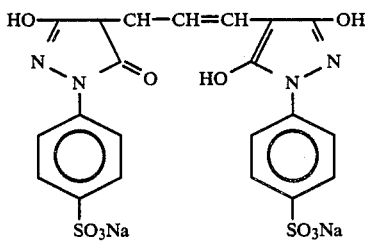

D-5

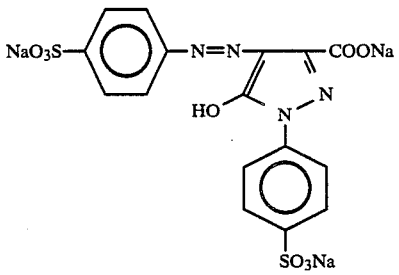

Oil-1 Tricresyl phosphate
Oil-2 Dibutyl phthalate

Each emulsion grain used consisted of a multiple twin, and the aspect ratio was under 3 for Emulsions A–D respectively of the eleventh layer, tenth layer, seventh layer and fourth layer.

The dry film thickness (represented as d below) from the third to the thirteenth layers was 19.0 μm.

The photographic material thus prepared was exposed to light imagewise and then subjected to continuous processing at 10 $m^2$ per day for 15 days using an automatic developing machine according to the processing steps shown below. The carried-over amount of the processing solution of black and white development to the first rinsing bath was 50 ml/$m^2$.

| Processing Steps | Temperature (°C.) | Time (min.) | Replenisher Amount (ml) | Tank (l) |
|---|---|---|---|---|
| Black & White Development | 38 | 6 | 2200 | 10 |
| First Rinsing | 38 | 1 | 2200 | 2 |
| Reversal | 38 | 1 | 1100 | 2 |
| Color Development | 38 | 6 | 2200 | 10 |
| Bleaching | 38 | 3 | 1100 | 5 |
| Bleach-fix | 38 | 3 | 1100 | 5 |
| Water Washing ① | 33 | 1 | — | 2 |
| Water Washing ② | 33 | 1 | 1100 | 2 |
| Stabilizing | 33 | 1 | 110 | 2 |
| Drying | 60 | 2 | — | — |

In this processing operation, the replenishing of washing water in the washing steps was carried out by a countercurrent mode in which the overflowed washing water of washing step ② is fed to step ①, and the replenishing solution is fed to step ②. The overflow solution of first rinsing step was fed to water washing step ② together with the replenishing water.

The overflow bleaching solution was fed to the bleach-fix bath.

The composition of each processing solution was as follows:

-continued

| Black & White Developing Solution | Tank Solution | Replenisher |
|---|---|---|
| Pentasodium nitrilo-N,N,N—tri methylenephosphonate | 2.0 g | 2.0 g |
| Sodium sulfite | 30 g | 30 g |
| Potassium hydroquinonemono-sulfonate | 20 g | 20 g |
| Potassium carbonate | 33 g | 33 g |
| 1-Phenyl-4-hydroxymethyl-4-methyl-3-pyrazolidone | 2.0 g | 2.0 g |
| Potassium bromide | 2.5 g | — |
| Potassium thiocyanate | 1.2 g | 1.2 g |
| Potassium iodide (0.1% solution) | 2 ml | — |
| Water to make | 1000 ml | 1000 ml |
| pH | 9.60 | 9.65 |

(pH was adjusted by hydrochloric acid or potassium hydroxide.)

First Rinsing Solution (both tank solution and replenisher)

A, J, K, L, M, Solutions: Same as Example 2.

O Solution

| | |
|---|---|
| $KH_2PO_4$ | 6.0 g |
| 5-Sulfosalicyclic acid | 1.5 g |
| Water to make | 1000 ml |
| pH 7.0 | |

Reversal solution (both tank solution and replenisher)

| | |
|---|---|
| Pentasodium nitrilo-N,N,N—tri-methylenephosphonate | 3.0 g |
| Stannous chloride (dihydrate) | 1.0 g |
| p-Aminophenol | 0.1 g |
| Sodium hydroxide | 8 g |
| Glacial acetic acid | 15 ml |
| Water to make | 1000 ml |
| pH 6.0 | |

(pH was adjusted by hydrochloric acid or sodium hydroxide.)

| Color Developing Solution | Tank Solution | Replenisher |
|---|---|---|
| Pentasodium nitrilo-N,N,N—tri methylene phosphonate | 2.0 g | 2.0 g |
| Sodium sulfite | 7.0 g | 7.0 g |
| Trisodium phosphate (12 hydrate) | 36 g | 36 g |
| Potassium bromide | 1.0 g | 0.3 g |
| Potassium iodide (0.1% solution) | 90 ml | — |
| Sodium hydroxide | 3.0 g | 3.0 g |
| Citrazinic acid | 1.5 g | 1.5 g |
| N—Ethyl-N—(β-methanesul-fonamidoethyl)-3-methyl-4-aminoaniline sulfate | 11 g | 11 g |
| 3,6-Dithiaocthane-1,8-diol | 1.0 g | 1.0 g |
| Water to make | 1000 ml | 1000 ml |

-continued

| | | |
|---|---|---|
| pH | 11.80 | 12.05 |
| (pH was adjusted by hydrochloric acid or sodium hydroxide.) | | |
| Bleaching Solution (Both tank solution and replenisher) | | |
| Ammonium bromide | 100 g | |
| Ammonium iron (III) ethylenediaminetetraacetate | 120 g | |
| Bleaching accelerator | | |

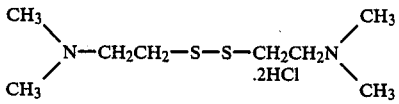

| | |
|---|---|
| Disodium ethylenediaminetetraacetate | 10.0 g |
| Sodium nitrate | 10.0 g |
| Water to make | 1000 ml |
| pH 6.5 | |

| Bleach-fix Solution | Tank Solution | Replenisher |
|---|---|---|
| Ammonium bromide | 50 g | — |
| Ammonium iron (III) ethylenediaminetetraacetate | 60 g | — |
| Disodium ethylenediaminetetraacetate | 5 g | 1.0 g |
| Ammonium nitrate | 5 g | — |
| Sodium sulfite | 12.0 g | 20.0 g |
| Sodium thiosulfate | 240 ml | 400 ml |
| Water to make | 1000 ml | 1000 ml |
| pH | 7.3 | 8.0 |
| Washing Water ① - ② (both tank solution and replenisher) | | |
| Same as Example 1. | | |
| Stabilizing Solution | | |
| Water | 800 ml | |
| Formalin (37%) | 5.0 ml | |
| Fuji Driwel (surfactant of polyoxyethylene nonylphenyl ether series) | 5.0 ml | |
| Water to make | 1000 ml | |

After the continuous processing, measurements similar to those of Example 1 were carried out. The results are shown in Table 3.

TABLE 3

| Test No. | First Rinsing Solution | | Absorbency of the First Rinsing Solution | Yellow Density of White Area | Yellow Density of Black Area | pH Value of First Rinsing Solution after Continuous Processing |
|---|---|---|---|---|---|---|
| 1 | A | Comparative Example | 1.28 | 0.14 | 2.93 | 9.70 |
| 2 | J | This Invention | 0.21 | 0.07 | 3.13 | 7.20 |
| 3 | K | This Invention | 0.28 | 0.07 | 3.20 | 7.25 |
| 4 | L | This Invention | 0.25 | 0.07 | 3.18 | 7.33 |
| 5 | M | This Invention | 0.18 | 0.06 | 3.10 | 7.30 |
| 6 | N | This Invention | 0.15 | 0.06 | 3.15 | 7.25 |
| 7 | O | This Invention | 0.17 | 0.06 | 3.12 | 7.22 |

As is apparent from the results in Table 3, in each of Tests No. 2 to No. 6, as compared to Test No. 1, the absorbency, i.e., the coloration of the first rinsing solution is distinctly low, and good photographic image with a lower density of the white area and higher minimum density is obtained.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for continuously processing a silver halide color reversal photographic material, which comprises subsequent to black and white development rinsing said silver halide color reversal photographic material which has been subjected to imagewise exposure, reversing said material, subjecting said material to color development, desilvering said material and then treating said material with at least one step selected from the group consisting of water washing, stabilizing and combinations thereof, wherein the replenishing amount per unit area of the photographic material in a rinsing bath is 3 to 50 times as much as the amount of processing solution carried over by the photographic material from the preceding bath in terms of volume ratio, said volume ratio being the ratio by volume of the volumetric replenishing amount for the rinsing bath: volumetric amount carried over from the preceding bath, and the pH of the rinsing bath is 9.5 or below.

2. The method for processing as claimed in claim 1, wherein the pH of said rinsing bath is controlled in a range 5.0–9.5 by use of buffers.

3. The method for processing as claimed in claim 1, wherein the amount of buffer in the rinsing bath is about $1.0\times10^{-5}$ mol to about 1.0 mol per liter of the rinsing solution.

4. The method for processing as claimed in claim 1, wherein the rinsing bath includes a chelating agent.

5. The method for processing as claimed in claim 4, wherein the chelating agent is selected from aminophosphonic acid compounds and organic phosphonic acid compounds.

6. The method for processing as claimed in claim 5, wherein the amount of the chelating agent is $1.0\times10^{-4}$ mol to $1\times10^{-1}$ mol, per liter of the rinsing solution.

7. The method for processing as claimed in claim 1, wherein the overflow solution of the rinsing bath is used as the replenishing solution or part of the replenishing solution for a washing bath after a processing bath having a fixing ability, or for a washing bath subsequent to a color developing bath.

8. The method for processing as claimed in claim 1, wherein the replenishing amount for each processing bath per unit area of the color reversal photographic material is 2.5 liters or less per $m^2$ of the photographic material and the total of the replenishing amounts is 12.5 liters or less per $m^2$ of the photographic material.

9. The method of processing as claimed in claim 1, wherein the color reversal photographic material is rinsed in accordance with multi-stage countercurrent replenishing system using two or more tanks.

10. The method for processing as claimed in claim 1, wherein the color development is carried out using a color developing solution having a pH of 9 or over.

11. The method for processing as claimed in claim 1, wherein the developing agent is used in concentration of about 1.0 g to about 15 g per liter of the color developing solution.

12. The method for processing as claimed in claim 1, wherein the color reversal photographic material is subjected to subsequent processes after the rinsing bath without being treated in a washing bath.

13. A method for continuously processing a silver halide color reversal photographic material, which comprises immediately after black and white developing rinsing said silver halide color reversal photographic material which has been subjected to imagewise exposure, reversing said material, subjecting said material to color development, desilvering said material, wherein the replenishing amount per unit area of the photographic material in a rinsing bath is 3 to 50 times as much as the amount of processing solution carried over by the photographic material from the preceding bath in terms of volume ratio, said volume ratio being the ratio by volume of the volumetric replenishing amount for rinsing bath: volumetric amount carried over from the preceding bath, and the pH in the rinsing bath is 9.5 or below, and subjecting said photographic material to subsequent processes including substantially no processing in a water washing bath.

14. The method for processing as claimed in claim 1, wherein the pH of the rinsing bath is maintained between 5 and 9.5.

15. The method for processing as claimed in claim 1, wherein the pH of the rinsing bath is maintained between 6 and 9.0.

16. The method for processing as claimed in claim 1, wherein the pH of the rinsing bath is maintained between 7.0 and 8.0.

17. The method for processing as claimed in claim 2, wherein the buffers are selected from the group consisting of phthalates, phosphates, citrates, succinates, tetraborates, borates, tartrates, lactates, carbonates, propionates, isopropionates, butyrates, isobutyrates, glycine salts, dimethylglycine salts, diethylbarbiturates, 2,4,6-trismethylpyridine salts, tris(hydroxymethyl)aminomethane salts, 2-amino-2-methyl-1,3-propanediol salts, and ammonium salts.

* * * * *